US007395840B2

(12) United States Patent
Ito

(10) Patent No.: US 7,395,840 B2
(45) Date of Patent: Jul. 8, 2008

(54) INDUSTRIAL SINGLE-LAYER FABRIC HAVING CONCAVE-CONVEX SURFACE

(75) Inventor: Senri Ito, Tokyo (JP)

(73) Assignee: Nippon Filcon Co. Ltd., Tokyo (JP)

( * ) Notice: Subject to any disclaimer, the term of this patent is extended or adjusted under 35 U.S.C. 154(b) by 13 days.

(21) Appl. No.: 11/438,216

(22) Filed: May 23, 2006

(65) Prior Publication Data

US 2006/0278296 A1 Dec. 14, 2006

(30) Foreign Application Priority Data

May 26, 2005 (JP) ..... 2005-153655
May 27, 2005 (JP) ..... 2005-155391

(51) Int. Cl.
*D21F 7/08* (2006.01)
*D03D 25/00* (2006.01)

(52) U.S. Cl. ..... 139/383 A; 139/383 R; 162/358.1

(58) Field of Classification Search ..... 139/383 A; 162/348, 358.2, 903
See application file for complete search history.

(56) References Cited

U.S. PATENT DOCUMENTS 2,554,034 A * 5/1951 Koester et al. ..... 139/426 R
3,216,893 A * 11/1965 Schuster ..... 245/8
3,596,858 A * 8/1971 Curtis ..... 245/10
3,851,681 A 12/1974 Kaukauna
4,149,571 A 4/1979 Burroughs et al.
4,281,689 A * 8/1981 Benedyk ..... 139/420 A
4,423,755 A * 1/1984 Thompson ..... 139/383 A
4,529,013 A * 7/1985 Miller ..... 139/383 A
4,676,278 A * 6/1987 Dutt ..... 139/383 AA
4,832,090 A * 5/1989 Krenkel et al. ..... 139/383 A
4,989,647 A * 2/1991 Marchand ..... 139/383 A
4,996,100 A * 2/1991 Druckman ..... 442/213
5,103,875 A * 4/1992 Tate et al. ..... 139/383 A
5,158,118 A * 10/1992 Tate et al. ..... 139/383 A
5,429,686 A * 7/1995 Chiu et al. ..... 139/383 A
5,487,414 A * 1/1996 Kuji et al. ..... 139/383 A (Continued)

FOREIGN PATENT DOCUMENTS

JP 2004-027407 A 1/2004

(Continued)

OTHER PUBLICATIONS

European Search Report, Jul. 25, 2006.

(Continued)

*Primary Examiner*—Bobby H Muromoto, Jr.
(74) *Attorney, Agent, or Firm*—Rader, Fishman & Grauer, PLLC

(57) ABSTRACT

An industrial single-layer fabric having a concave-convex upper side surface and a lower side surface comprises warps, wefts and auxiliary wefts having a smaller diameter than the wefts. On the upper side surface in a repeating unit, at least two kinds of upper side knuckles are formed by each of the warps that passes over one weft and zero to two auxiliary wefts. On the lower side surface in the repeating unit, at least two kinds of lower side knuckles are formed by each of the warps that passes under one weft and zero to four auxiliary wefts. The wefts form a plain weave design by alternatively passing over one warp and passing under one warp.

10 Claims, 17 Drawing Sheets

U.S. PATENT DOCUMENTS 5,518,042 A * 5/1996 Wilson ..... 139/383 A
5,632,310 A * 5/1997 Yasuoka ..... 139/383 A
5,713,398 A * 2/1998 Josef ..... 139/383 A
5,832,962 A * 11/1998 Kaufman et al. ..... 139/383 A
5,853,547 A 12/1998 Ahrens et al.
5,944,062 A * 8/1999 Gampe ..... 139/383 A
6,077,397 A * 6/2000 Shipley ..... 162/358.1
6,227,255 B1 * 5/2001 Osterberg et al. ..... 139/383 A
6,431,221 B1 * 8/2002 Wrigley ..... 139/383 AA
6,790,314 B2 * 9/2004 Burazin et al. ..... 162/109
2005/0067039 A1 3/2005 Lafond et al.

FOREIGN PATENT DOCUMENTS

JP 2005-009013 A 1/2005

OTHER PUBLICATIONS

Annex to the European Search Report.

* cited by examiner

2A4A
2B4B
2C4C
2D4D
3A
3B
A
B
C
D
1
2
3
4
2´
3
4´
5
6´
7
8´

8´
7
6´
5
4´
3
2´
1
18A
18B
18C
18D
19A
19B
A
B
C
D

INDUSTRIAL SINGLE-LAYER FABRIC HAVING CONCAVE-CONVEX SURFACE

TECHNICAL FIELD

The present invention relates to an industrial single-layer fabric suited as a fabric capable of putting marks to a non-woven fabric or paper, having excellent fiber supporting property and bulkiness, and can be used in a high-speed machine.

The disclosure of Japanese Patent Application Nos. 2005-153655 filed May 26, 2005 and 2005-155391 filed on May 27, 2005 including specification, drawings and claims is incorporated herein by reference in its entirety.

BACKGROUND ART

As an industrial fabric with a concave-convex surface, fabrics woven with warps and wefts have so far been used widely. Such fabrics have been used in a variety of fields including wires for manufacture of non-woven fabrics, paper-making wires, and conveyor belts. Their concave-convex structure is effective for imparting marks or special feeling to paper or non-woven fabrics or for preventing slippage of transported goods.

In particular, fabrics for putting marks to non-woven fabrics or paper are strictly requested to satisfy fiber supporting property, sheet release property and adaptability to high-speed machine as well as adequate height of their concaves and convexes. In recent years, with a speedup of non-woven fabric manufacturing machine or paper manufacturing machine, the above-described request has been stricter.

Fabrics for putting marks can be manufactured by various processes. As described in Japanese Patent Laid-Open Publication No. 2005-9013, such a fabric is manufactured by forming a float (long crimp) of warps and wefts on the fabric surface, thereby providing a height difference in each region. In Japanese Patent Laid-Open Publication No. 2004-27407, described is a process of arranging warps of a large diameter at some intervals, and putting marks by utilizing a difference in height at the top portion of a knuckle between a warp of a small diameter and a warp of a large diameter. These processes are effective for giving a geometric pattern, characters or strains, or sporadic patterns different from main pattern, but are not suited for giving bulkiness to non-woven fabrics by making use of the constitution of the whole fabric.

At present, fabrics for putting marks have problems such as scattering of a sheet raw material owing to the speedup of machine. In wet forming, fibers are supplied to the machine together with a large amount of water so that the speedup of machine can be actualized to some extent. In dry forming, however, fiber raw materials very light in weight are supplied onto a fabric so that they sometimes scatter when treated by a high-speed machine. This phenomenon is marked when fiber raw materials are supplied onto a fabric having a relatively flat surface. A fabric having a structure facilitating entanglement of fibers or having a marked concave-convex structure will overcome the problem of scattering. But in such a fabric, fibers sometimes get under constituent yarns to deteriorate the sheet release property. As described above, a property for preventing fibers from scattering, sheet release property and concave-convex imparting property are properties which cannot be satisfied simultaneously.

SUMMARY OF THE INVENTION

An object of the present invention is to provide an industrial single-layer fabric having a concave-convex surface, which fabric is excellent in fiber supporting property, sheet release property and adaptability to high-speed machine and suited for the manufacture of a bulky non-woven fabric or paper with marks.

The present invention relates to an industrial single-layer fabric having a concave-convex surface, which comprises warps, wefts and auxiliary wefts having a smaller diameter than the wefts. In a repeating unit of the industrial single-layer fabric, the warps have a design of having at least two kinds of upper side knuckles formed by a warp that passes over one to three yarns in total, that is, one weft and zero to two auxiliary wefts on the upper side surface. On the lower side surface of the industrial single-layer fabric, at least two kinds of lower side knuckles are formed by a warp that passes under one to five yarns in total, that is, one weft and zero to four auxiliary wefts. The wefts of the industrial single-layer fabric form a plain weave design in the repeating unit by alternatively passing over one warp and passing under one warp on each of the upper side surface and lower side surface.

Each of the upper side knuckles formed by a warp that passes over one weft and zero to two auxiliary wefts in a repeating unit may be any one of a first knuckle formed by a first warp that successively passes over two yarns in total, that is, one weft and one auxiliary weft which are adjacent to each other, a second knuckle formed by a second warp that successively passes over two yarns in total, that is, one auxiliary weft and one weft which are adjacent to each other, a third knuckle formed by a third warp that successively passes over three yarns in total, that is, one weft and two auxiliary wefts which are adjacent to one another, a fourth knuckle formed by a fourth warp that successively passes over three yarns in total, that is, two auxiliary wefts and one weft which are adjacent to each other, a fifth knuckle formed by a fifth warp that successively passes over three yarns in total, that is, one auxiliary weft, one weft and one auxiliary weft which are adjacent to one another, and a sixth knuckle formed by a sixth warp that passes over a weft.

Each one of the warps above may have only one repeating design which is one of the first through sixth knuckles on the upper side surface.

Alternatively, each one of the warps may have a design that repeats any two of the first through sixth knuckles on the upper side surface of the repeating unit.

Further alternatively, one of the warps may have a design that repeats only one of the six knuckles and another one of the warps may have a design that repeats any two of the first through sixth knuckles in a repeating unit.

The wefts and the auxiliary wefts may be arranged at a ratio of from 2:1 to 2:3. The auxiliary wefts each may have one design or two designs. The warps and wefts may be any one of monofilaments, bundled monofilaments or twisted yarns. The auxiliary wefts may be any one of monofilaments, multifilaments, twisted yarns, fancy yarns, and hollow yarns.

At least a portion of the warps and/or wefts may be a flat yarn. The warps may be more protruded from the upper side or lower side surface than the wefts.

The first, second, third, fourth, fifth and sixth knuckles formed on the surface of the fabric of the present invention are each a convex portion formed on the upper side surface by a warp passing over a weft, or a weft and an auxiliary weft along their shapes. The first knuckle is formed by a warp successively passing over two yarns in total, that is, one weft and one auxiliary weft which are adjacent to each other, the second knuckle is formed by a warp successively passing over two yarns in total, that is, one auxiliary weft and one weft which are adjacent to each other, the third knuckle is formed by a warp successively passing over three yarns in total, that is, one weft and two auxiliary wefts which are adjacent to each other, the fourth knuckle is formed by a warp successively passing over three yarns in total, that is, two auxiliary wefts and one weft which are adjacent to each other, the fifth knuckle is formed by a warp successively passing over three yarns in total, that is, one auxiliary weft, one weft and one auxiliary weft which are adjacent to one another, and the sixth knuckle is formed by a warp passing over a weft.

The industrial single-layer fabric according to the present invention is excellent in fiber supporting property, sheet release property and adaptability to high-speed machine and is suited for the manufacture of a bulky non-woven fabric by employing a plain-weave-based design in which at least two warp knuckles different in shape are placed at random on the upper surface side.

Figures 1, 2A, 2B, 2C, 2D:
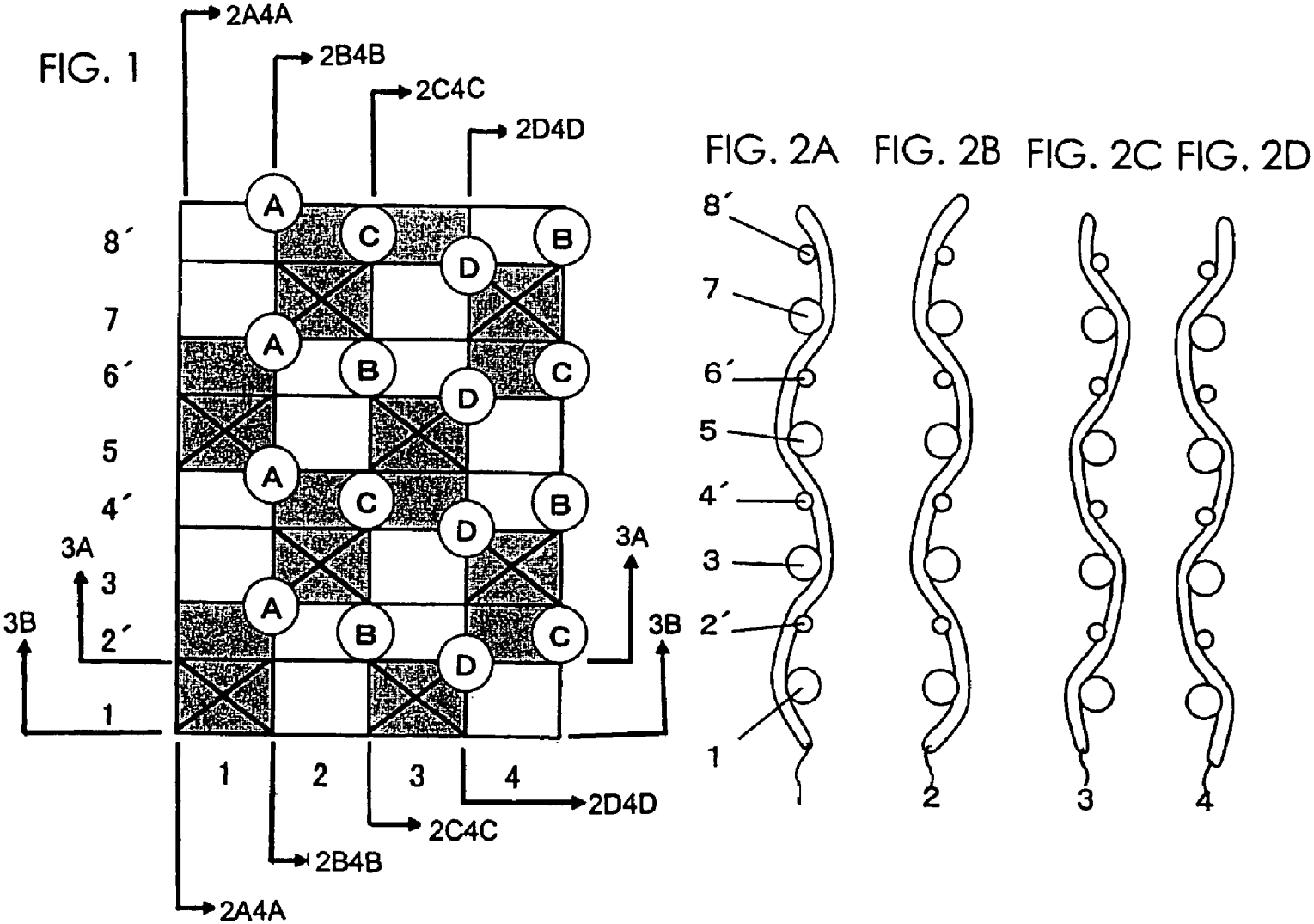
FIG. 1 is a design diagram showing a repeating unit of a fabric of Example 1 according to the present invention.
FIGS. 2A through 2D include cross-sectional views taken along the lines 2A-2A, 2B-2B, 2C-2C and 2D-2D of warps 1, 2, 3 and 4 of FIG. 1 respectively.

In the figures, the numerals of 1, 2, 3 . . . 15 denote warps and wefts, and the numerals of 1', 2', 3' . . . 16' denote auxiliary wefts.

DETAILED DESCRIPTION OF THE INVENTION

The fabric of the present invention is suited for use in the manufacturing fields of non-woven fabric by spunbonding, meltblowing, airlaid, spunlacing, wet forming, dry forming or the like method. Bulky non-woven fabric or paper with concave-convex patterns can be obtained by giving concave-convex patterns to the fabric or paper during manufacturing step of the non-woven fabric or paper or drying step by TAD (Through Air Dryer).

The fabric of the present invention is an industrial single-layer fabric composed of warps, wefts and auxiliary wefts having a smaller diameter than wefts. In principle, wefts are preferably thick and rigid and a plurality of warp knuckles different in shape are formed at random on these relatively straight wefts. In the fabric of the present invention, the top portion of a warp knuckle becomes a convex portion, while an intersection of warps formed between two adjacent wefts becomes a concave. A concave-convex structure is thus formed by the difference in height between them. The convex portion is also composed of a plurality of warp knuckles different in shape, which makes the concave-convex structure more complicated. In the present invention, plural kinds of concave-convex portions are formed utilizing not the floating length of warps or wefts but the height difference and difference in the shape of warp knuckles. It adopts a plain weave structure mainly. Warps and wefts have a plain weave structure assuming that auxiliary wefts are excluded therefrom.

In the present invention, the term "warp knuckle" means a convex portion formed by a warp passing over or under one weft while following the shape of the weft; or means a convex portion formed by a warp passing over or under one weft and one or plural auxiliary wefts which are adjacent to each other (one another), while following the shape of them. A warp therefore has such a diameter and material quality as to facilitate bending and formation of a knuckle. The diameter and material of each yarn has a large influence on the height between concave and convex. For example, when a flexible yarn is used as a weft, a warp knuckle has a low height because the weft bends at the intersection between the warp and weft. Use of a weft which is rigid but has a small diameter makes the whole fabric relatively flat. Use of a warp which is not flexible prevents firm weaving of warps and wefts, leading to a fabric having poor stability.

Auxiliary wefts are necessary for forming a plurality of warp knuckles different in shape. For example, knuckles formed by a warp successively passing over a weft and an auxiliary weft are different in shape and arrangement from those formed by a warp passing successively over an auxiliary weft and a weft. When a difference in diameter between auxiliary weft and weft is small, a difference in shape between knuckles becomes small, whereby convex portions similar in shape are formed on the entire surface of the fabric. Such a fabric is not always undesirable. Anyway, it is necessary to thoroughly examine the balance of the diameter of yarns and material used for them.

Wefts and auxiliary wefts may be arranged at 1:1, which means that one auxiliary weft is arranged relative to one weft, or 1:2, or 2:1 which means that two wefts are arranged, followed by arrangement of one auxiliary weft. Additional examples include arrangement in the order of one weft, one auxiliary weft, one weft and two auxiliary wefts, and arrangement in the order of one weft, one auxiliary weft, two wefts and one auxiliary weft.

Although no particular limitation is imposed on the arrangement ratio or arrangement composition of wefts and auxiliary wefts, a design of arranging three or more wefts continuously is not preferred because it disturbs formation of knuckles different in shape. Therefore, two wefts at a maximum are arranged continuously. Similarly, continuous arrangement of three or more auxiliary wefts is not preferred, because in spite of an increase in the variation of knuckle shapes, it prevents firm weaving of warps and wefts and therefore deteriorates stability of knuckles. Two auxiliary wefts at a maximum are preferably arranged continuously.

On the upper side surface, at least two upper side knuckles different from each other are formed by a warp passing over one weft and zero to two auxiliary wefts. The knuckles formed on the upper side surface are, for example, a first knuckle formed by a warp successively passing over two yarns in total, that is, one weft and one auxiliary weft which are adjacent to each other, a second knuckle formed by a warp successively passing over two yarns in total, that is, one auxiliary weft and one weft which are adjacent to each other, a third knuckle formed by a warp successively passing over three yarns in total, that is, one weft and two auxiliary wefts which are adjacent to each other, a fourth knuckle formed by a warp successively passing over three yarns in total, that is, two auxiliary wefts and one weft adjacent to each other, a fifth knuckle formed by a warp successively passing over three yarns in total, that is, one auxiliary weft, one weft and one auxiliary weft which are adjacent to one another, and a sixth knuckle formed by a warp passing over a weft.

Of these knuckles, two or more knuckles different from each other may be formed as a fabric design. The term "knuckles different from each other" as used herein means knuckles passing over wefts and auxiliary wefts which are different in number and different in arrangement. For example, the first knuckle formed by a warp passing over two yarns in total, that is, one weft and one auxiliary weft which are adjacent to each other is different from the second knuckle formed by a warp passing over two yarns in total, that is, one auxiliary weft and one weft which are adjacent to each other. A difference between the first knuckle and the second knuckle is the position of the auxiliary weft adjacent to the weft, but these knuckles formed over a straight weft become different. In addition, one of these knuckles is arranged on the front side including a weft and the other one is arranged on the back side including a weft so that these knuckles are not linearly arranged in the lateral direction. As a result, the fabric has a concave-convex surface while having two or more knuckles different in shape arranged at random.

Examples of the fabric design in which two or more different knuckles are formed include a fabric in which a warp having a design of always repeating a first knuckle and another warp having a design of always repeating a second knuckle are arranged alternately; and a fabric in which a warp having a design of always repeating a first knuckle and another warp having a design of alternately repeating a fifth knuckle and a sixth knuckle are arranged as needed. Not only them but also a fabric in which three kinds of warps each repeating the same knuckle are arranged as needed may be employed.

Although no particular limitation is imposed on the design of auxiliary wefts, a design of passing over many continuous warps is not preferred. Auxiliary wefts arranged between wefts exhibit their effects for improving the fiber supporting property. An object of the present invention is to form warp knuckles different in shape on the upper side surface so that too long portion of auxiliary wefts which are not woven with warps limits the design of the fabric. In addition, when such a fabric is used for the manufacture of a non-woven fabric, there is a fear of raw material fibers hiding under long auxiliary wefts to deteriorate the sheet release property. Such defects therefore must be taken into consideration. Auxiliary wefts preferably have a design of passing over and under one warp, or a design of passing over continuous two warps and under continuous two warps. Auxiliary wefts may have one or plural designs, but as a whole fabric, they preferably have one or two designs. Arrangement of too many designs is not preferred from the viewpoints of weaving property and tension balance of the fabric.

Wefts have a plain weave design, that is, a design of alternately passing over and under one warp, on the upper side and lower side. Warps have a design which will be a plain weave design after exclusion of auxiliary wefts therefrom. In the fabric of the present invention, a complex concave-convex surface is formed not utilizing the length of a float of a weft or warp but utilizing a height difference between the top portion of a warp knuckle and an intersection of warps between two adjacent wefts or a concave portion formed by auxiliary wefts, and difference in shape between warp knuckles. Warps and wefts therefore have a plain weave design in principle.

In the plain weave design of the wefts employed in present invention, rigid wefts difficult to bend are woven with warps easy to form a convex shape so that the wefts do not protrude from each of the upper side and lower side surfaces. All the wefts however pass over one warp and then pass under one warp successively so that the design is regarded as a plain weave design.

Although no particular limitation is imposed on the lower side surface, a warp may have a design which will be a plain weave design after exclusion of auxiliary wefts therefrom. A proper design may be selected in view of the relationship with the upper side surface design. The fabric of the present invention has, on the lower side surface, at least two kinds of lower side knuckles formed by a warp passing under one weft and zero to four auxiliary wefts. With regards to the lower side knuckle formed on the lower side by a warp, the number of wefts is necessarily one, while the number of auxiliary wefts to be combined with the weft may be zero, one, two, three or, at a maximum, four. Examples of the lower side knuckle may include that formed by a warp passing under one weft, that formed by a warp successively passing under two yarns in total, that is, one weft and one auxiliary weft which are adjacent to each other, that formed by a warp successively passing under three yarns in total, that is, one auxiliary weft, one weft and one auxiliary weft which are adjacent to one another, that successively formed by a warp successively passing under three yarns in total, that is, two auxiliary wefts and one weft which are adjacent to one another, and that formed by a warp successively passing under five yarns in total, that is, two auxiliary wefts, one weft and two auxiliary wefts which are adjacent to one another. On the lower side surface, two or more knuckles are necessary but which warp forms which knuckle is not limited. The fabric may have a design in which one warp always forms two knuckles on the lower side or a design in which at least two kinds of warps each always forming the same knuckle are arranged.

Yarns to be used in the present invention may be selected depending on the using purpose. Examples of them include, in addition to monofilaments, multifilaments, spun yarns, finished yarns subjected to crimping or bulking such as so-called textured yarn, bulky yarn and stretch yarn, and yarns obtained by intertwining them. The material of the yarn can be selected freely and usable examples of it include polyester, polyamide, polyphenylene sulfide, polyvinylidene fluoride, polypropylene, aramid, polyether ether ketone, polyethylene naphthalate, polytetrafluoroethylene, cotton, wool and metal. Of course, yarns obtained using copolymers or mixing the above-described material with various substances selected depending on the intended purpose may be used. For static protection, a conductive yarn is sometimes mixed in yarns constituting a fabric for manufacturing a non-woven fabric. Similarly, a conductive yarn may be employed as some or whole of the yarns constituting the fabric of the present invention.

In a high-temperature atmosphere, polyphenylene sulfide is preferred, while polyester or polyamide is usually employed for industrial fabrics. In particular, rigid yarns difficult to bend are preferred as wefts constituting the fabric of the present invention so that monofilaments, bundled monofilaments and twisted yarns are suited. In addition, those having a relatively large diameter are preferred. As warps, yarns having a diameter and material quality which facilitate bending along the shape of wefts or auxiliary wefts to form a knuckle are preferred. Monofilaments, bundled monofilaments or twisted yarns are suited. Those having a smaller diameter than wefts are preferred. As auxiliary wefts, monofilaments, multiflaments, twisted yarns, fancy yarns and hollow yarns are preferred. Since auxiliary wefts are also used for regulating tension of warps having enhanced flexibility during weaving of a fabric, yarns not rigid as wefts but flexible are preferred.

For use in the manufacture of a non-woven fabric, flat yarns may be used because they are stain-resistant, can be washed easily and are suited for forming a flat joint for endless splicing. In the present invention, as warps, wefts and auxiliary wefts, not only yarns having a circular cross-section but also yarns in the square or short form such as stellar form, or flat, elliptical or hollow form can be used. They may of course be used in combination. For example, yarns having a flat cross-section may be used as warps, while those having a circular cross-section may be used as wefts and auxiliary wefts. Some of the flat warps may be replaced with two edge-matched circular warps. For example in a high-speed machine for manufacturing a non-woven fabric, when the surface of a fabric is excessively smooth, a fibrous sheet formed on the fabric sometimes scatters. A fabric may therefore be woven using two edge-matched circular warps as some of flat warps to form a structure in which fibers stick into the fabric. In such a fabric, adequate sticking of fibers thereto is effective for preventing scattering of the sheet. Arrangement of many edge-matched circular warps however may sometimes deteriorate the sheet release property because of the excessive sticking of fibers into the fabric so that the number of edge-matched circular warps must be selected as needed.

In this specification, the terms "upper side surface" and "lower side surface" are used for facilitating understanding. The fabric of the present invention is a single layer fabric so that either of them may be a raw material contact surface or machine contact surface.

EXAMPLES

Modes for carrying out the invention will next be explained based on Examples with reference to accompanying drawings.

FIGS. 1 to 34 illustrate Examples of the present invention and they are any of a design diagram, a cross-sectional view taken along a warp, and a cross-sectional view taken along a weft. In the design diagram, the minimum repeating unit of a fabric design is illustrated. The whole fabric is formed by connecting this complete design laterally and longitudinally. In the design diagram, warps and wefts are indicated by Arabic numerals, for example 1, 2 and 3, where auxiliary wefts are indicated by Arabic numerals with a prime, for example, 1', 2' and 3'.

In these diagrams, a mark "x" means that a warp lies over a weft. A portion where a warp passes over a weft and an auxiliary weft to form a warp knuckle is hatched.

In the design diagram and cross-sectional view, wefts and auxiliary wefts are placed at equal intervals, but they sometimes deviate from the illustrated positions.

Example 1

Figure 3A:
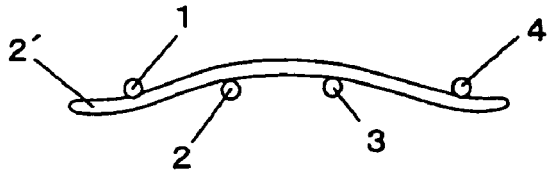
FIGS. 3A and 3B include cross-sectional views taken along the lines 3A and 3B of auxiliary weft 2' and weft 1 of FIG. 1 respectively.
Figure 3B:
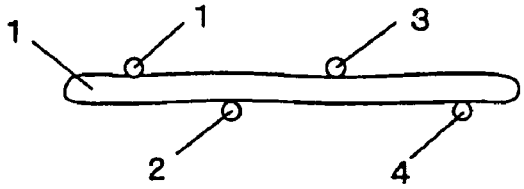

FIG. 1 is a design diagram illustrating a repeating unit of a fabric of Example 1 of the present invention. FIGS. 2A through 2D include cross-sectional views taken along the lines 2A-2A, 2B-2B, 2C-2C and 2D-2D of warps 1, 2, 3 and 4 of FIG. 1 respectively. FIGS. 3A and 3B include cross-sectional views taken along the lines 3A and 3B of auxiliary weft 2' and weft 1 of FIG. 1 respectively. FIGS. 4A through 4D include cross-sectional views taken along the lines 4A-4A, 4B-4B, 4C-4C and 4D-4D of warps 1 and 2, warps 2 and 3, warps 3 and 4 and warps 4 and 1 of FIG. 1 respectively, illustrating two adjacent warps 1 and 2, warps 2 and 3, warps 3 and 4, and warps 4 and 1 intersecting each other. Wefts and auxiliary wefts are placed alternately at a ratio of 1:1. Symbols A to D in the design diagram indicate the positions of concave portions A to D.

As wefts, yarns having a relatively large diameter and rigid enough not to bend easily were employed, while as warps and auxiliary wefts, yarns easy to bend to form knuckles were used. As can be seen from the cross-sectional view of FIG. 3B taken along weft 1, a curved knuckle was formed on both sides, that is, the upper side and lower side of a relatively straight weft.

As is illustrated in FIGS. 1 and 2A through 2D, the upper side surface is made of two knuckles, that is, a first knuckle formed by a warp which successively passes over one weft and one auxiliary weft which are adjacent to each other and a second knuckle formed by a warp which successively passes over one auxiliary weft and one weft which are adjacent to each other. Described specifically, in warp 1, a knuckle which passes over weft 1 and auxiliary weft 2' adjacent to each other and a knuckle which passes over weft 5 and auxiliary weft 6' adjacent to each other are first knuckles, while in warp 3, a knuckle which passes over auxiliary weft 4' and weft 5 adjacent to each other and a knuckle which passes over auxiliary weft 8' and weft 1 adjacent to each other are second knuckles. The cross-sectional views of warps 1 and 3 in FIGS. 2A and 2C also show that knuckles different in shape are formed As is apparent from weft 1 of FIG. 3B, the wefts of Example 1 have a plain weave design of alternately passing over one warp and under one warp. As can be seen from the cross-section of the warps 1 through 4 shown in FIGS. 2A through 2D respectively, each of the warps 1, 3, 5 and 7 has a design which is a plain weave design of alternately passing over one weft and under one weft, if the auxiliary wefts 2', 4', 6', and 8' are excluded. Auxiliary wefts 2', 4', 6', and 8' have the same design, that is, a design of passing over two warps and under two warps 1, 2, 3 and 4. They have a proper length so that they improve the fiber supporting property without damaging sheet release property.

The lower side surface is formed by lower side knuckles which pass under one lower surface side weft and one auxiliary weft adjacent to each other.

The concave-convex of this fabric will next be described with reference to FIGS. 4A through 4D including the cross-sectional views of warps 1 through 4 adjacent to each other. As is illustrated in the design diagram of FIG. 1, warps are placed in the numerical order 1, 2, 3 and 4. Warp 1 has a design of passing over weft 1 and auxiliary weft 2' to form a first knuckle on the upper side surface, passing under weft 3 and auxiliary weft 4', forming a first knuckle over weft 5 and auxiliary weft 6', and then passing under weft 7 and auxiliary weft 8'. Warp 2 has a design of passing under weft 1 and auxiliary weft 2', passing over weft 3 and auxiliary weft 4' to form a first knuckle on the upper side surface, passing under weft 5 and auxiliary weft 6', and then forming a first knuckle on weft 7 and auxiliary weft 8'. As a result, in warps 1 and 2 which are adjacent to each other, first knuckles are formed successively on weft 1 and auxiliary weft 2', on weft 3 and auxiliary weft 4', on weft 5 and auxiliary weft 6' and on weft 7 and auxiliary weft 8'. These knuckles correspond to a convex portion. At the intersection between warps 1 and 2, concave portion A is formed as seen in FIGS. 1 and 2A. This concave portion exists at the lowest level of intersection of warp 1 which drops from the upper side of auxiliary weft 2' to the lower side of weft 3 and warp 2 which drops from the upper side of weft 3 to the lower side of auxiliary weft 2'. There appears a difference in height between the top portion of the first knuckle and this concave portion. Concave portion A is also formed between weft 4 and auxiliary weft 5', between weft 6 and auxiliary weft 7' and between wert 8 and auxiliary weft 1'.

With regards to warps 2 and 3, as illustrated in FIGS. 1 and 2B, warp 2 has a design of passing under weft 1 and auxiliary weft 2', passing over weft 3 and auxiliary weft 4' to form a first knuckle on the upper side surface, passing under weft 5 and auxiliary weft 6' and passing over weft 7 and auxiliary weft 8' to form a first knuckle, while warp 3 has a design of passing over auxiliary weft 8' and weft 1 to form a second knuckle on the upper side surface, passing under auxiliary weft 2' and weft 3, forming a second knuckle on auxiliary weft 4' and weft 5 and passing under auxiliary weft 6' and weft 7. As a result, warps 2 and 3 form a second knuckle and a first knuckle successively on auxiliary weft 8' and weft 1, weft 3 and auxiliary weft 4', auxiliary weft 4' and weft 5, and weft 7 and auxiliary weft 8'. Top portions of these knuckles correspond to convex portions different in shape. Concave portion B and concave portion C are formed at the intersections between warp 2 and warp 3.

Concave portion B exists at the intersection between warp 3 which drops from the upper side of weft 1 to the lower side of auxiliary weft 2' and warp 2 which drops from the upper side of weft 3 to the lower side of auxiliary weft 2'. At this lowest point, auxiliary weft 2' exists. Concave portion B in which auxiliary weft 6' exists is also formed between weft 5 and weft 7. In such a manner, a concave portion in which an auxiliary weft exists is formed between the top portion of a first knuckle and the top portion of a second knuckle, leading to appearance of a difference in height.

Figure 4A:
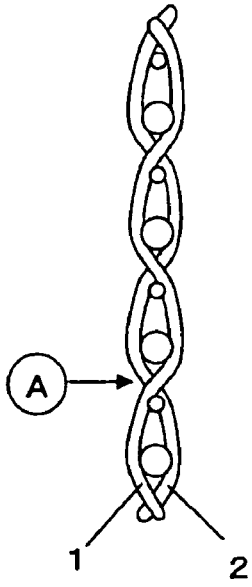
FIGS. 4A through 4D include cross-sectional views taken along the lines 4A-4A, 4B-4B, 4C-4C and 4D-4D of warps 1 and 2, warps 2 and 3, warps 3 and 4 and warps 4 and 1 of FIG. 1 respectively, each two warps being adjacent to each other.
Figure 4B:
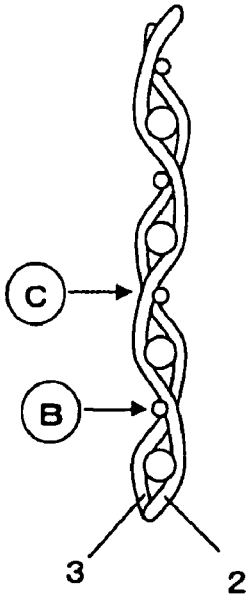

Concave portion C exists, as illustrated in FIGS. 1 and 4B, at the intersection of warp 2 passing over auxiliary weft 4' and warp 3 passing over auxiliary weft 4'. Concave portion C is not deeper than concave portion A or concave portion B because it does not exist at an intersection formed by a warp dropping downward. It is however concaved compared with the top portion of a knuckle. Similarly, concave portion C is formed on auxiliary weft 8'.

Figure 4C:
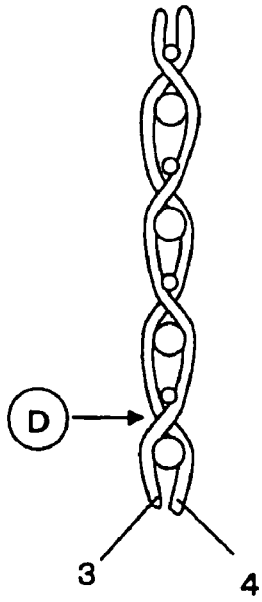

With regards to warps 3 and 4, as illustrated in FIGS. 1 and 4C, warp 3 has a design of passing over auxiliary weft 8' and weft 1 to form a second knuckle on the upper side surface, passing under auxiliary weft 2' and weft 3, forming a second knuckle on auxiliary weft 4' and weft 5 and then passing under auxiliary weft 6' and weft 7, while warp 4 has a design of passing under auxiliary weft 8' and weft 1, passing over auxiliary weft 2' and weft 3 to form a second knuckle on the upper side surface, passing under auxiliary weft 4' and weft 5, and then forming a second knuckle on auxiliary weft 6' and weft 7. As a result, in warps 3 and 4, a second knuckle is formed successively on auxiliary weft 8' and weft 1, on auxiliary weft 2' and weft 3, on auxiliary weft 4' and weft 5 and auxiliary weft 6' and weft 7. The top portions of these knuckles correspond to convex portions. Concave portion D is formed at the intersection between warp 3 and warp 4. This position is the lowest position where warp 3 which drops from the upper side of weft 1 to the lower side of auxiliary weft 2' and warp 4 which drops from the upper side of auxiliary weft 2' to the lower side of weft 1 intersect each other. A height difference therefore appears between the top portion of a second knuckle and the concave portion. Concave portion D is formed also between weft 3 and auxiliary weft 4', weft 5 and auxiliary weft 6', and weft 7 and auxiliary weft 8'.

Figure 4D:
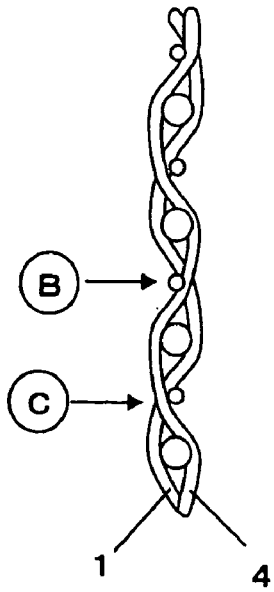

With regards to warp 4 and warp 1, as illustrated in FIGS. 1 and 4D, warp 4 has a design of passing under auxiliary weft 8' and weft 1, passing over auxiliary weft 2' and weft 3 to form a second knuckle on the upper surface side, passing under auxiliary weft 4' and weft 5, and then forming a second knuckle on auxiliary weft 6' and weft 7, while warp 1 has a design of passing over weft 1 and auxiliary weft 2' to form a first knuckle on the upper surface side, passing under weft 3 and auxiliary weft 4', forming a first knuckle on weft 5 and auxiliary weft 6', and then passing under weft 7 and auxiliary weft 8'. As a result, in warp 4 and warp 1, a first knuckle and a second knuckle are formed successively on weft 1 and auxiliary weft 2', auxiliary weft 2' and weft 3, weft 5 and auxiliary weft 6' and auxiliary weft 6' and weft 7. The top portions of these knuckles correspond to concave portions different in shape. Between warps 4 and 1, concave portion C and concave portion B are formed by the intersection of warps.

Concave portion C exists at the intersection between warp 4 which passes over auxiliary weft 2' and warp 1 which passes over auxiliary weft 2'. Concave portion C does not exist at the intersection of warps dropping downward so that it is not deeper than concave portion A, concave portion B and concave D. It is however concaved compared with the top portion of a knuckle. Similarly, concave portion C is formed on auxiliary weft 6'.

Concave portion B exists at the intersection between a warp 4 dropping from the upper side of weft 3 to the lower side of auxiliary weft 4' and warp 1 dropping from the upper side of weft 5 to the lower side of auxiliary weft 4'. It is the lowest position where auxiliary weft 4' exists. Similarly, concave portion B at which auxiliary weft 8' exists is formed between weft 7 and weft 1. In this manner, a concave portion at which an auxiliary weft exists is formed between the top portion of a first knuckle and the top portion of a second knuckle, leading to the appearance of a height difference.

In such a manner, first knuckle and second knuckle different in shape and concave portions A, B, C and D different in shape are formed on the upper side surface. As described above, not only these concave portions are different in depth or shape but also they are not arranged linearly in the same row direction as can be understood from the arrangement of symbols A to D in the design diagram of FIG. 1. Described specifically, around auxiliary weft 2', concave portion A is formed between auxiliary weft 2' and weft 3 between warps 1 and 2, concave portion B is formed on auxiliary weft 2' between warps 2 and 3, concave portion D is formed between weft 1 and auxiliary weft 2' between warps 3 and 4, and concave portion C is formed on auxiliary weft 2' between warps 4 and 1. Thus, the fabric is equipped with convexes and concaves, which are different in shape and depth, disposed at random. By making use of this fabric, a concave-convex pattern which cannot be actualized by other fabrics can be given to non-woven fabric or the like and the fabric has excellent adaptability to high-speed machine, fiber supporting property and sheet release property.

Example 2

Figure 6B:
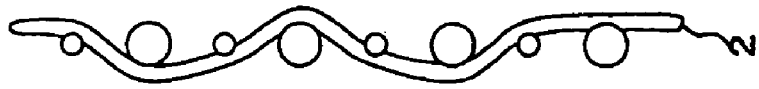
FIGS. 6A and 6B include cross-sectional views taken along the lines 6A-6A and 6B-6B of warps 1 and 2 of FIG. 5 respectively.
Figure 6A:
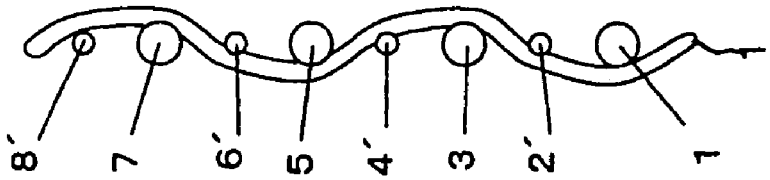
Figure 5:
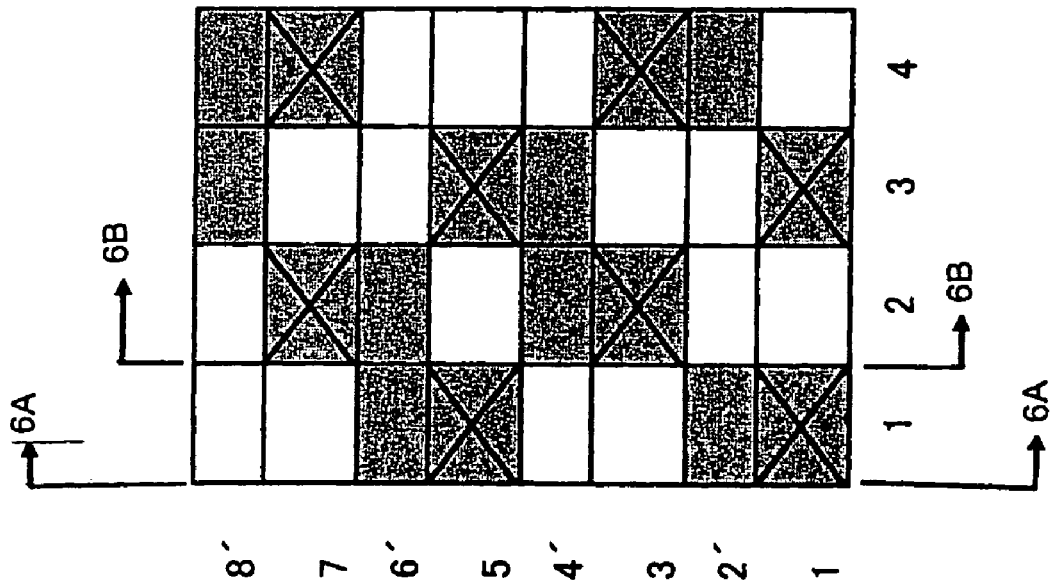
FIG. 5 is a design diagram showing a repeating unit of a fabric of Example 2 according to the present invention.

FIG. 5 is a design diagram showing a repeating unit of a fabric of Example 2 of the present invention. FIGS. 6A and 6B include cross-sectional views taken along the lines 6A-6A and 6B-6B of warps 1 and 2 of FIG. 5 respectively. Wefts 1, 3, 5 and 7 and auxiliary wefts 2', 4', 6' and 8' are alternately arranged at a ratio of 1:1. The upper side surface is made of first and second knuckles which pass over one weft and one auxiliary weft which are adjacent to each other. Auxiliary wefts have one design, wefts have a plain weave design of alternately passing over one warp and under one warp, and warps have a design which will be a plain weave design of alternately passing over one weft and under one weft after exclusion of auxiliary wefts.

This fabric of Example 3 has three warp designs warp 1 has a design of repeating a first knuckle only, warps 2 and 4 have a design of repeating a first knuckle and a second knuckle, and warp 3 has a design of repeating a second knuckle only. By these designs, concave-convex portions different in shape are formed. Concave portions are different in depth and shape and in addition, they are not arranged in the same row direction. The fabric is, as a whole, equipped with convex portions and concave portions, which are different in shape and depth, disposed at random.

Example 3

Figure 7:
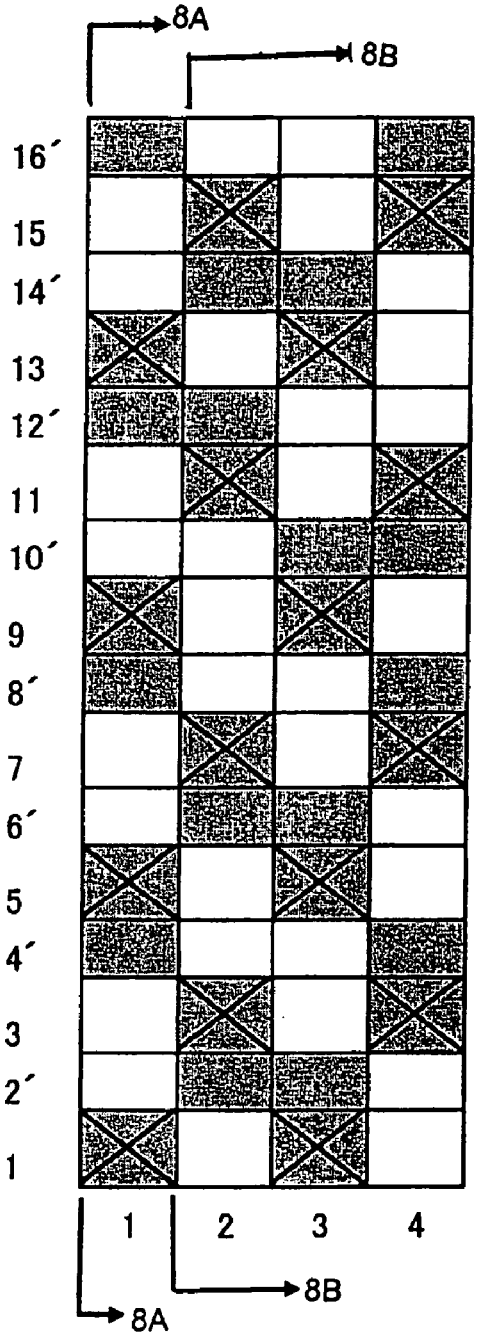
FIG. 7 is a design diagram showing a repeating unit of a fabric of Example 3 according to the present invention.
Figure 8A:
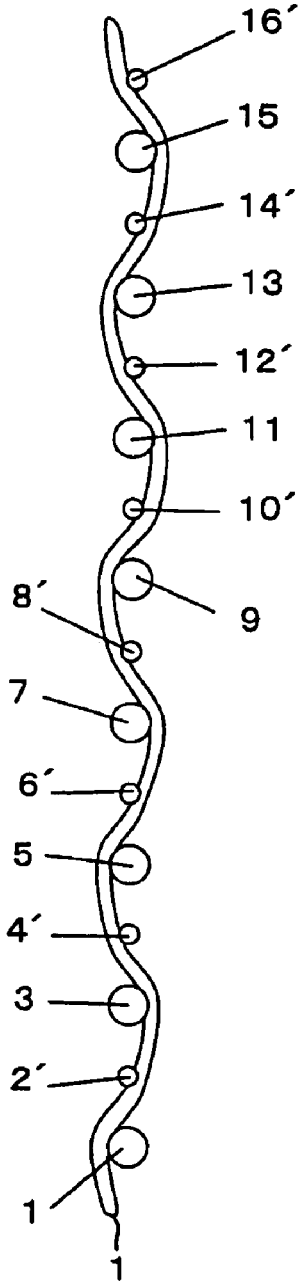
FIGS. 8A and 8B include cross-sectional views taken along the lines 8A-8A and 8B-8B of warps 1 and 2 of FIG. 7.
Figure 8B:
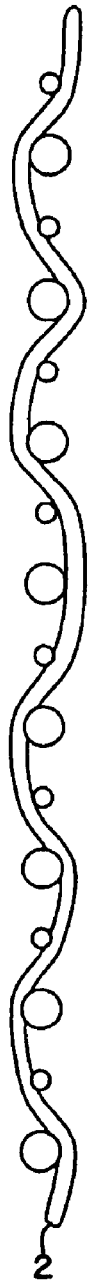

FIG. 7 is a design diagram showing a repeating unit of a fabric of Example 3 of the present invention. FIGS. 8A and 8B include cross-sectional views taken along the lines 8A-8A and 8B-8B of warps 1 and 2 of FIG. 7. Wefts 1, 3, 5, 7, 9, 11, 13 and 15, and auxiliary wefts 2', 4', 6', 8', 10', 12', 14' and 16' are alternately arranged at a ratio of 1:1. The upper side surface is made of first and second knuckles passing over one weft and one auxiliary weft which are adjacent to each other. Auxiliary wefts have one design, wefts have a plain weave design of alternately passing over one warp and under one warp, and warps have a design which will be a plain weave design of alternately passing over one weft and under one weft after exclusion of auxiliary wefts.

This fabric of Example 3 has four warp designs. Warp 1 has a design of repeating a second knuckle only, warp 2 has a design of repeating a first knuckle and three second knuckles, warp 3 has a design of repeating four first knuckles, and warp 4 has a design of repeating three first knuckles and one second knuckle. By these designs, concave and convex portions different in shape are formed. Concave portions are different in depth and shape and in addition, they are not arranged in the same row direction. The fabric is, as a whole, equipped with convex and concave portions, which are different in shape and depth, disposed at random.

Example 4

Figure 9:
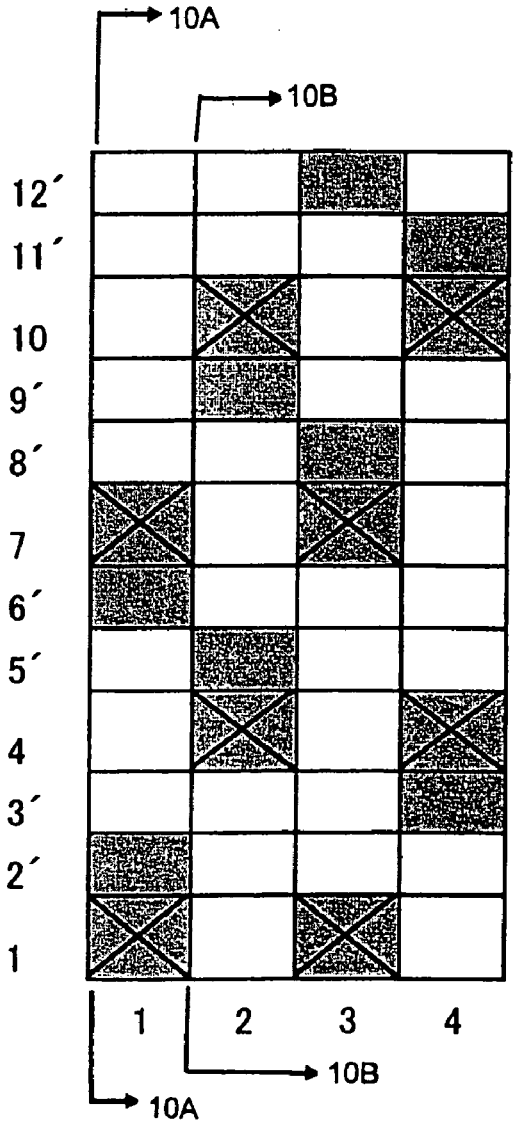
FIG. 9 is a design diagram showing a repeating unit of a fabric of Example 4 according to the present invention.
Figure 10A:
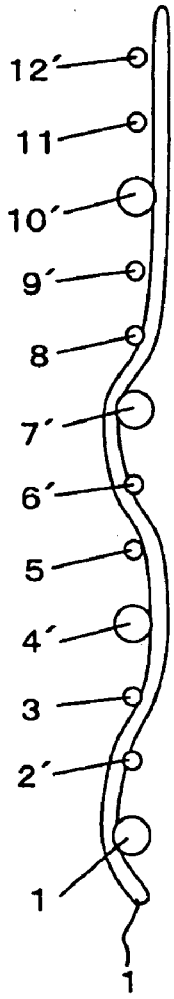
FIGS. 10A and 10B include cross-sectional views taken along the lines 10A-10A and 10B-10B of warps 1 and 2 of FIG. 9 respectively.
Figure 10B:
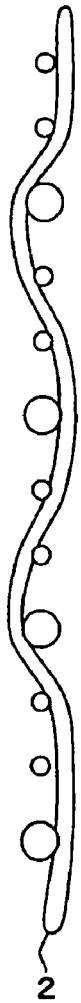

FIG. 9 is a design diagram of a repeating unit of a fabric of Example 4 of the present invention. FIGS. 10A and 10B include cross-sectional views taken along the lines 10-10A and 10B-10B of warps 1 and 2 of FIG. 9 respectively. Wefts 1, 4, 7 and 10 and auxiliary wefts 2', 3', 5', 6', 8', 9', 10' and 12' are arranged at a ratio of 1:2. The upper side surface is made of first and second knuckles passing over one weft and one auxiliary weft which are adjacent to each other. Auxiliary wefts have one design, wefts have a plain weave design of alternately passing over one warp and under one warp, and warps have a design which will be a plain weave design of alternately passing over one weft and under one weft after exclusion of auxiliary wefts. In this example, two auxiliary wefts are placed between wefts, but this arrangement does not destroy the fundamental plain weave design.

This fabric has one warp design. Warps 1, 2, 3 and 4 have a design of repeating a first knuckle and a second knuckle. By this design, concave-convex portions different in shape are formed. Concave portions are different in depth and shape and in addition, they are not arranged in the same row direction. The fabric is, as a whole, equipped with convex and concave portions, which are different in shape and depth, disposed at random.

Example 5

Figure 11:
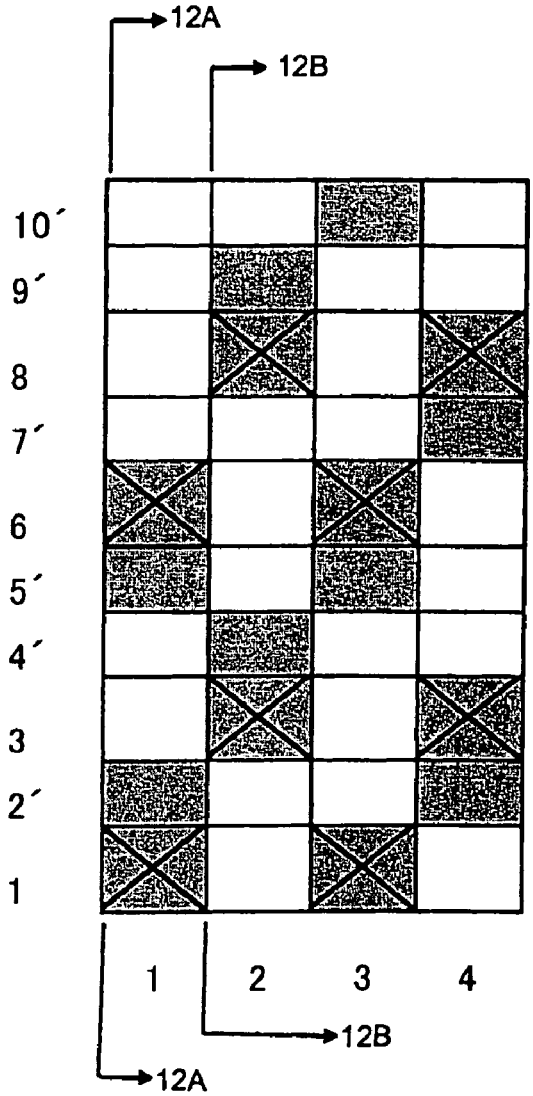
FIG. 11 is a design diagram showing a repeating unit of a fabric of Example 5 according to the present invention.
Figure 12A:
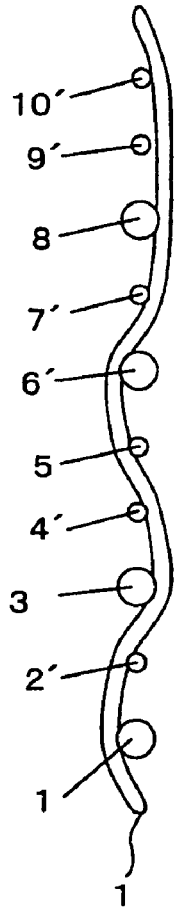
FIGS. 12A and 12B include cross-sectional views taken along the lines 12A-12A and 12B-12B of warps 1 and 2 of FIG. 11 respectively.
Figure 12B:
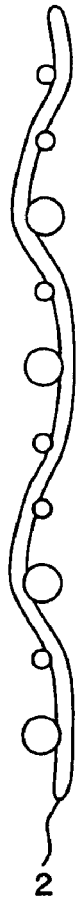

FIG. 11 is a design diagram of a repeating unit of a fabric of Example 5 of the present invention. FIGS. 12A and 12B include cross-sectional views taken along the lines 12A-12A and 12B-12B of warps 1 and 2 of FIG. 11 respectively. Combinations of one weft 1, 6 and one auxiliary weft 2', 7', and combinations of one weft 3, 8 and two auxiliary wefts 4', 5', and 9', 10' are arranged, meaning that wefts and auxiliary wefts are arranged at a ratio of 2:3. The upper side surface is made of first and second knuckles which pass over one weft and one auxiliary weft which are adjacent to each other. Auxiliary wefts have a design of passing over two warps and passing under two warps, and another design of passing over one warp and passing under three warps. Wefts have a plain weave design of alternately passing over one warp and under one warp, and warps have a weave design which will be a plain weave design of alternately passing over one weft and under one weft after exclusion of auxiliary wefts.

In this Example, one weft, one auxiliary weft, one weft and two auxiliary wefts are arranged in this order. Even such an arrangement does not destroy the fundamental plain weave design. This fabric has one warp design. Warps 1, 2, 3 and 4 have a design of repeating a first knuckle and a second knuckle. By this design, concave-convex portions different in shape are formed. Concave portions are different in depth and shape and in addition, they are not arranged in the same row direction. The fabric is, as a whole, equipped with convex and concave portions, which are different in shape and depth, disposed at random.

Example 6

Figure 13:
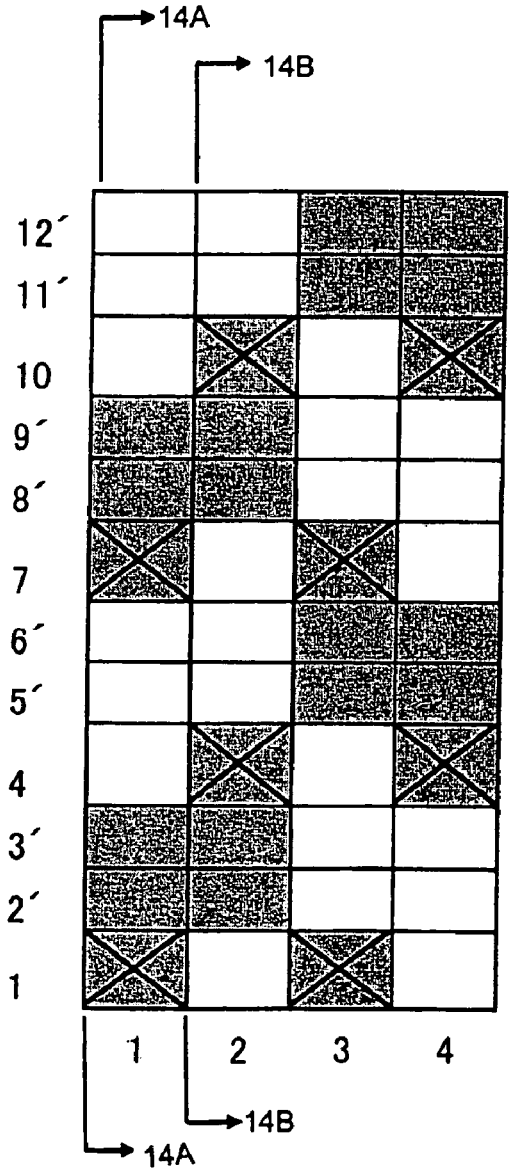
FIG. 13 is a design diagram showing a repeating unit of a fabric of Example 6 according to the present invention.
Figure 14A:
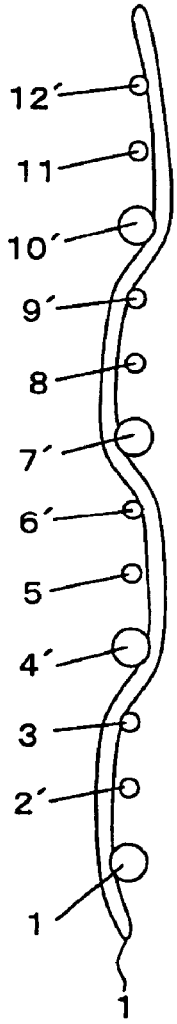
FIGS. 14A and 14B include cross-sectional views taken along the lines 14A-14A and 14B-14B of warps 1 and 2 of FIG. 13 respectively.
Figure 14B:
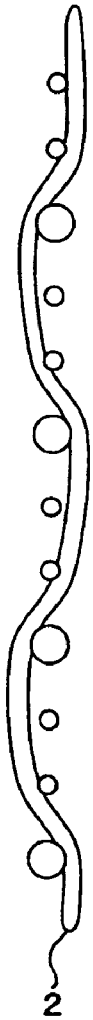

FIG. 13 is a design diagram showing a repeating unit of a fabric of Example 6 of the present invention. FIGS. 14A and 14B include cross-sectional views taken along the lines 14A-14A and 14B-14B of warps 1 and 2 of FIG. 13 respectively. Wefts 1, 4, 7 and 10 and auxiliary wefts 2', 3', 5', 6', 8', 9', 11' and 12' are arranged at a ratio of 1:2. The upper side surface is made of a third knuckle passing over one weft and two auxiliary wefts which are adjacent to one another and a fourth knuckle passing over two auxiliary wefts and one weft which are adjacent to one another. Auxiliary wefts have one design of passing over two warps and under two warps. Wefts have a plain weave design of alternately passing over one warp and under one warp, and warps have a design which will be a plain weave design of alternately passing over one weft and under one weft after exclusion of auxiliary wefts.

This fabric has two warp designs. Warps 1 and 4 have a design of repeating a third knuckle, and warps 2 and 3 have a design of repeating a fourth knuckle. By these designs, concave-convex portions different in shape are formed. Concave portions are different in depth and shape and in addition, they are not arranged in the same row direction. The fabric is, as a whole, equipped with convex and concave portions, which are different in shape and depth, disposed at random.

Example 7

Figures 16A, 16B, 16C:
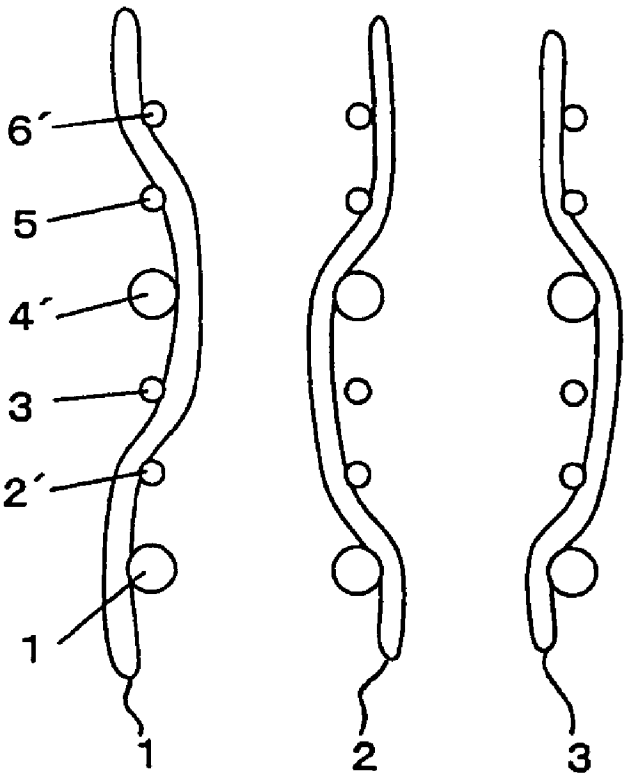
FIGS. 16A, 16B and 16C include cross-sectional views taken along the lines 16A-16A, 16B-16B and 16C-16C of warps 1 and 2 of FIG. 15 respectively.
Figure 15:
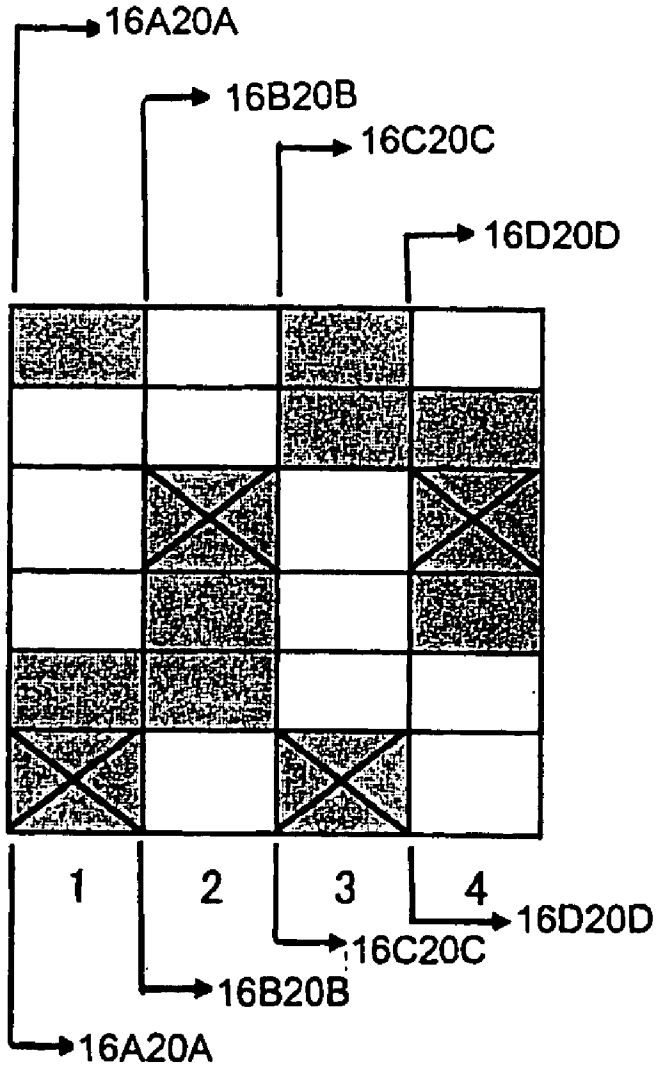
FIG. 15 is a design diagram showing a repeating unit of a fabric of Example 7 according to the present invention.

FIG. 15 is a design diagram showing a repeating unit of a fabric of Example 7 of the present invention. FIG. 16A, 16B and 16C include cross-sectional views taken along the lines 16A-16A, 16B-16B and 16C-16C of warps 1 and 2 of FIG. 15 respectively. Wefts 1 and 4 and auxiliary wefts 2', 3', 5' and 6' are arranged at a ratio of 1:2. The upper side surface is made of a fourth knuckle successively passing over two auxiliary wefts and one weft which are adjacent to one another and a fifth knuckle successively passing over one auxiliary weft, one weft and one auxiliary weft which are adjacent to one another. Auxiliary wefts have two designs, that is, a design, as represented by auxiliary wefts 2' and 5', of passing over two warps and under two warps and another design, as represented by auxiliary wefts 3' and 6', of passing over one warp and under one warp. Wefts have a plain weave design of alternately passing over one warp and under one warp, and warps have a design which will be a plain weave design of alternately passing over one weft and under one weft after exclusion of auxiliary wefts.

The fabric of this Example has two warp designs warps 1 and 4 have a design of repeating a fifth knuckle, and warps 2 and 3 have a design of repeating a fourth knuckle. By these designs, concave-convex portions different in shape are formed on the upper side surface. Concave portions are different in depth and shape and in addition, they are not arranged in the same row direction. The fabric is, as a whole, equipped with convex and concave portions, which are different in shape and depth, disposed at random.

Example 8

Figures 17, 18A, 18B, 18C, 18D:
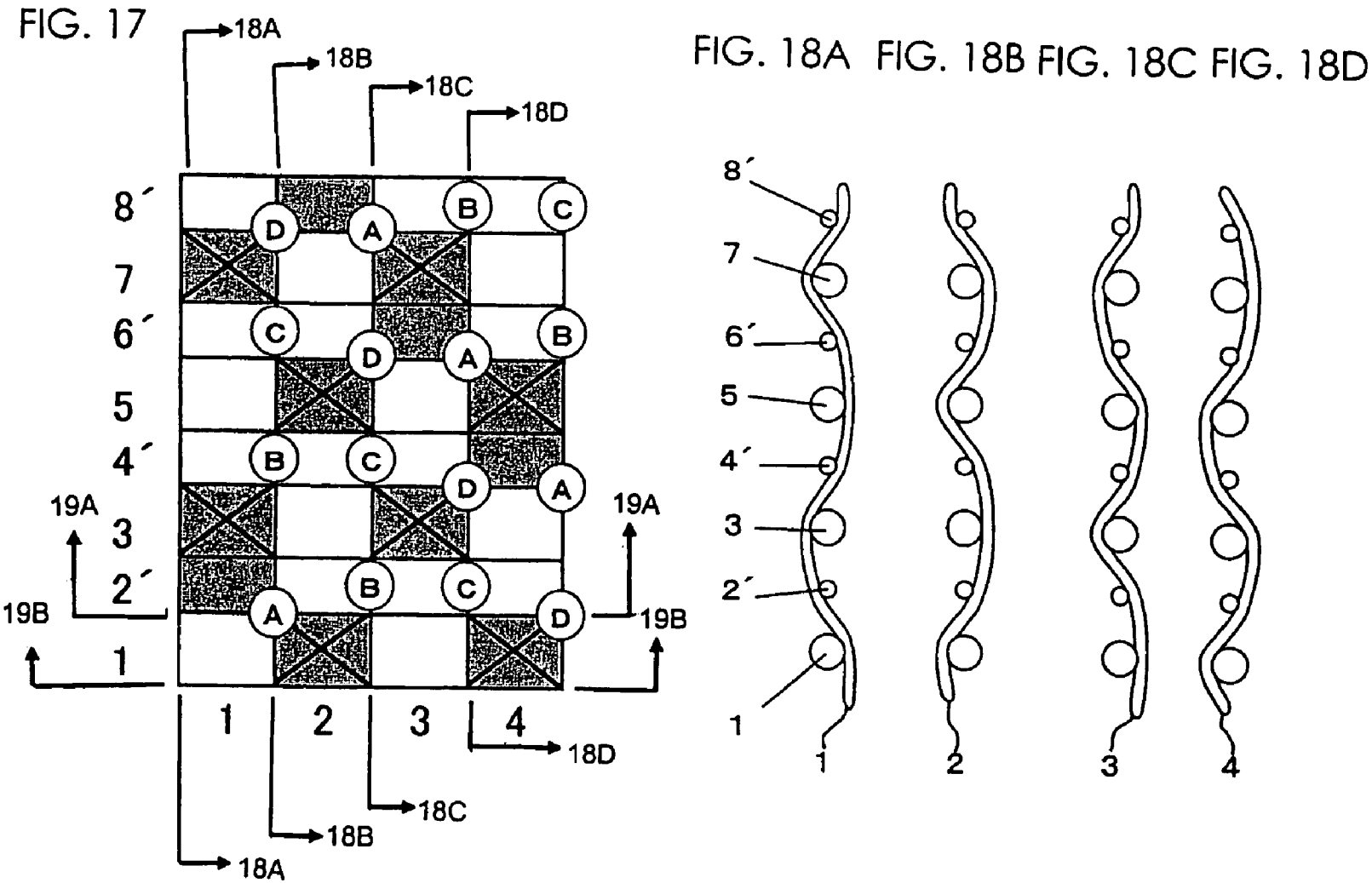
FIG. 17 is a design diagram showing a repeating unit of a fabric of Example 8 according to the present invention.
FIGS. 18A through 18D include cross-sectional views taken along the lines 17A-17A, 17B-17B, 17C-17C and 17D-17D of warps 1, 2, 3 and 4 of FIG. 17 respectively.
Figure 19A:
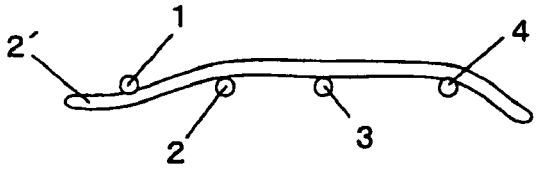
FIGS. 19A and 19B include cross-sectional views taken along the lines 19A-19A and 19B-19B of auxiliary weft 2' and weft 1 of FIG. 17 respectively.
Figure 19B:
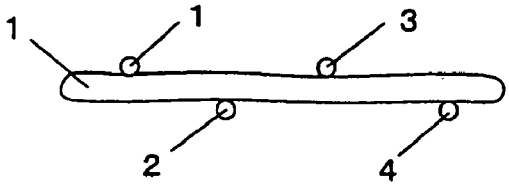
Figure 20A:
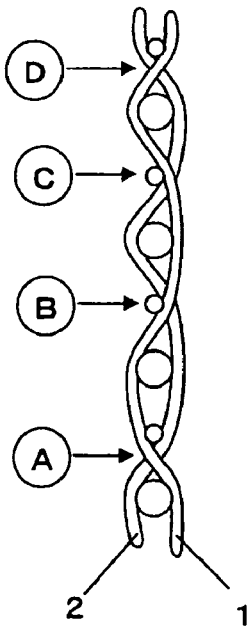
FIGS. 20A through 20D include cross-sectional views taken along the lines 20A-20A, 20B-20B, 20C-20C and 20D-20D of warps 1 and 2, warps 2 and 3, warps 3 and 4 and warps 4 and 1 of FIG. 17 respectively, each two warps being adjacent to each other.
Figure 20B:
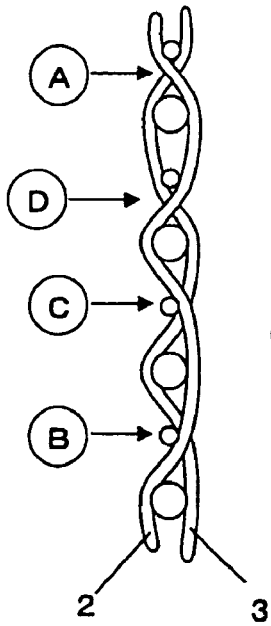
Figure 20C:
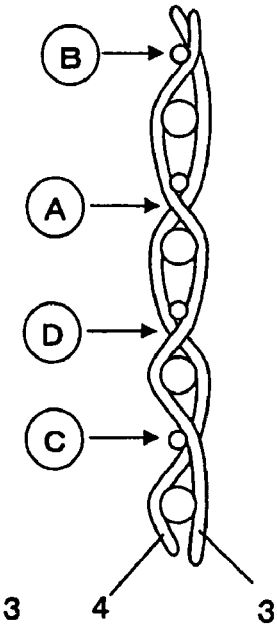
Figure 20D:
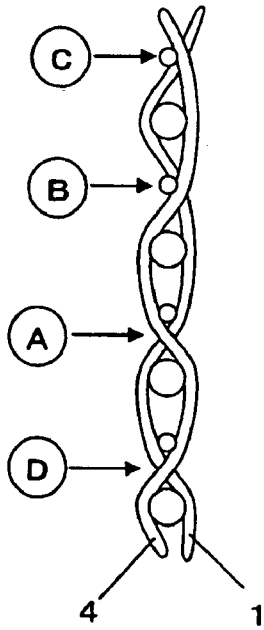

FIG. 17 is a design diagram of a fabric of Example 8 of the present invention. FIGS. 18A through 18D include cross-sectional views taken along the lines 17A-17A, 17B-17B, 17C-17C and 17D-17D of warps 1, 2, 3 and 4 of FIG. 17 respectively. FIGS. 19A and 19B include cross-sectional views taken along the lines 19A-19A and 19B-19B of auxiliary weft 2' and weft 1 of FIG. 17 respectively. FIGS. 20A through 20D include cross-sectional views taken along the lines 20A-20A, 20B-20B, 20C-20C and 20D-20D of warps 1 and 2, warps 2 and 3, warps 3 and 4 and warps 4 and 1 of FIG. 17 respectively, which are adjacent to and intersect each other. Wefts 1, 3, 5 and 7 and auxiliary wefts 2', 4', 6' and 8' are alternately arranged at a ratio of 1:1. Symbols A to D in the diagram indicate the positions of concave portions A to D.

The fabrics in Example 1 to 7 as illustrated in FIGS. 1 through 16C, have an upper side surface made of knuckles which are different in shape but equal in length. The fabrics in Example 8 or later, the fabrics have an upper side surface made of knuckles which are different in both shape and length.

As wefts, a yarn having a relatively large diameter and rigid enough not to bend easily may be employed, while as warps and auxiliary wefts, a yarn easy to bend to form a knuckle may be employed. As is apparent from the cross-sectional view taken along weft 1 of FIG. 19B, curved knuckles were formed on both sides, that is, on the upper side and lower side of a relatively straight weft 1.

As illustrated in FIGS. 17 and 18A-18D, the upper side surface is made of two warp knuckles different in length. Described specifically, it is made of a warp design having a second knuckle successively passing over an auxiliary weft and weft adjacent to each other and a sixth knuckle passing over one weft.

As is apparent from weft 1 of FIG. 19B, wefts 1, 3, 5 and 7 have a plain weave design of alternately passing over one warp and under one warp, and warps 1, 2, 3 and 4 have a design which is a plain weave design of alternately passing over one weft and under one weft, if auxiliary wefts are excluded. Auxiliary wefts 2', 4', 6' and 8' have the same design of passing over one warp and then under three warps.

The lower side surface is made of a lower side knuckle where a warp passes under one auxiliary weft and one weft which are adjacent to each other, and another lower side knuckle where a warp passes under one auxiliary weft, one weft and one auxiliary weft which are adjacent to one another.

The unevenness of this fabric will next be described with reference to FIGS. 20A through 20D showing the cross-sectional views of two warps adjacent to each other. Warps 1, 2, 3 and 4 are arranged in this order as shown in the design diagram of FIG. 17. Between warps 1 and 2, warp 1 has a design of passing over auxiliary weft 2' and weft 3 to form a second knuckle on the upper surface side, passing under auxiliary weft 4', weft 5 and auxiliary weft 6', forming a sixth knuckle on weft 7, and then passing under auxiliary weft 8' and weft 1, while warp 2 has a design of passing over auxiliary weft 8' and weft 1 to form a second knuckle on the upper surface side, passing under auxiliary weft 2', weft 3 and auxiliary weft 4', passing over weft 5 to form a sixth knuckle on the upper side surface and then passing under auxiliary weft 6' and weft 7. As a result, in warps 1 and 2, second, second, sixth and sixth knuckles formed successively on auxiliary weft 8' and weft 1, on auxiliary weft 2' and weft 3, on weft 5, and on weft 7, respectively. These knuckles correspond to convex portions. Concave portions A, B, C and D are formed between wefts by the intersection of warp 1 with warp 2.

Concave portion A exists at the lowest position where warp 1 drops from the upper side of auxiliary weft 2' to the lower side of weft 1 and warp 2 drops from the upper side of weft 1 to the lower side of auxiliary weft 2'; concave portion B exists at the lowest position where warp 1 drops from the upper side of weft 3 to the lower side of auxiliary weft 4' and warp 2 drops from the upper side of weft 5 to the lower side of auxiliary weft 4'; concave portion C exists at the lowest position where warp 1 drops from the upper side of weft 7 to the lower side of auxiliary weft 6' and warp 2 drops from the upper side of weft 5 to the lower side of auxiliary weft 6'; and concave portion D exists at the lowest position where warp 1 drops from the upper side of weft 7 to the lower side of auxiliary weft 8' and warp 2 drops from the upper side of auxiliary weft 8' to the lower side of weft 7. There appears a height difference between each of these four concave portions and the top portion of second knuckle.

With regards to warps 2 and 3, warp 2 has a design of passing over auxiliary weft 8' and weft 1 to form a second knuckle on the upper surface side, passing under auxiliary weft 2', weft 3 and auxiliary weft 4', forming a sixth knuckle on weft 5, and then passing under auxiliary weft 6' and weft 7, while warp 3 has a design of passing under auxiliary weft 8', weft 1 and auxiliary weft 2', passing over weft 3 to form a sixth knuckle on the upper side surface, passing under auxiliary weft 4' and weft 5, and passing over auxiliary weft 6' and weft 7 to form a second knuckle on the upper side surface. As a result, in warps 2 and 3, second, sixth, sixth and second knuckles are successively formed on auxiliary weft 8' and weft 1, on weft 3, on weft 5 and on auxiliary weft 6' and weft 7, respectively. These knuckles correspond to convex portions. Concave portions A, B, C and D are formed between wefts by the intersection of warp 2 with warp 3.

With regards to warps 3 and 4, warp 3 has a design of passing under auxiliary weft 8', weft 1 and auxiliary weft 2', passing over weft 3 to form a sixth knuckle on the upper surface side, passes under auxiliary weft 4' and weft 5, and passing over auxiliary weft 6' and weft 7 to form a second knuckle on the upper side surface, while warp 4 has a design of passing over weft 1 to form a sixth knuckle on the upper side surface, passing under auxiliary weft 2' and weft 3, forming a second knuckle on auxiliary weft 4' and weft 5, and then passing under auxiliary weft 6', weft 7 and auxiliary weft 8'. As a result, in warps 3 and 4, sixth, sixth, second and second knuckles are successively formed on weft 1, on weft 3, on auxiliary weft 4' and weft 5, and on auxiliary weft 6' and weft 7, respectively. These knuckles correspond to convex portions. Concave portions A, B, C and D are formed between wefts by the intersection of warp 3 with warp 4.

With regards to warps 4 and 1, warp 4 has a design of passing over weft 1 to form a sixth knuckle on the upper side surface, passing under auxiliary weft 2' and weft 3, forming a second knuckle on auxiliary weft 4' and weft 5, and then passing under auxiliary weft 6', weft 7 and auxiliary weft 8', while warp 1 has a design of passing under auxiliary weft 8' and weft 1, passing over auxiliary weft 2' and weft 3 to form a second knuckle on the upper surface side, passing under auxiliary weft 4', weft 5 and auxiliary weft 6', and forming a sixth knuckle on weft 7. As a result, in warps 4 and 1, sixth, second, second and sixth knuckles are successively formed on weft 1, on auxiliary weft 2' and weft 3, on auxiliary weft 4' and weft 5, and weft 7, respectively. These knuckles correspond to convex portions. Concave portions A, B, C and D are formed between wefts by the intersection of warp 4 with warp 1.

In the above-described manner, second knuckle and sixth knuckle different in shape and concave portions A, B, C and D different in shape are formed on the upper side surface. As described above, concave portions are different in depth and shape and in addition, they are not arranged in the same row direction as can be seen from the arrangement of symbols A to D in the design diagram of FIG. 1. Around auxiliary weft 2', concave portion A is formed between weft 1 and auxiliary weft 2' between warp 1 and warp 2; concave portion B is formed on auxiliary weft 2' between warp 2 and 3; concave portion C is formed on auxiliary weft 2' between warp 3 and warp 4; and concave portion D is formed between weft 1 and auxiliary weft 2' between warps 4 and 1. The fabric is thus equipped with convex and concave portions, which are different in shape and depth, disposed at random. The fabric has excellent adaptability to high-speed machine, fiber supporting property and sheet release property and by making use of this fabric, concave-convex patterns which cannot be actualized by other fabrics can be given to non-woven fabric or the like.

Example 9

Figure 21:
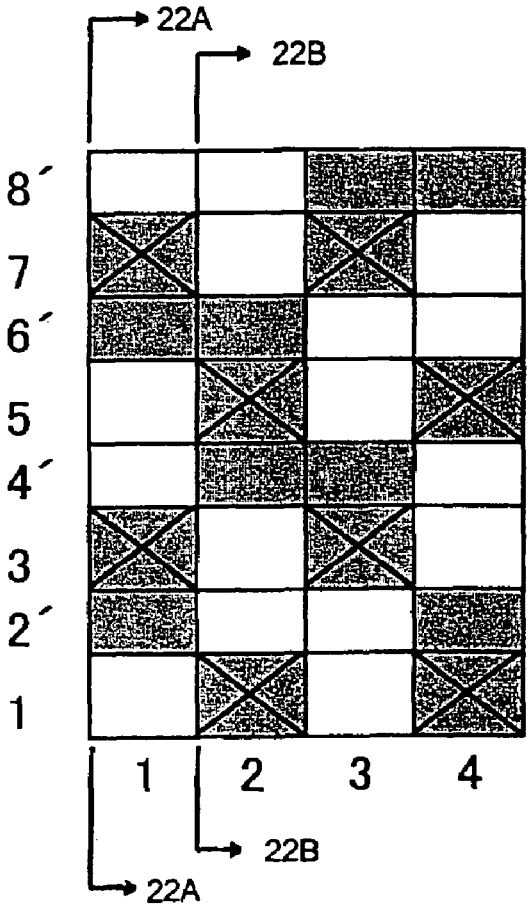
FIG. 21 is a design diagram showing a repeating unit of a fabric of Example 9 according to the present invention.
Figures 22A, 22B:
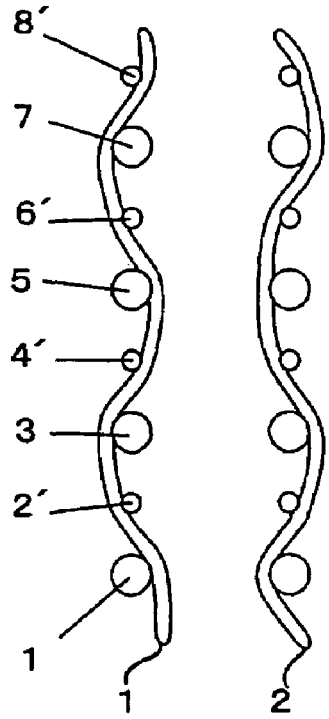
FIGS. 22A and 22B include cross-sectional views taken along the lines 22A-22A and 22B-22B of warps 1 and 2 of FIG. 21 respectively.

FIG. 21 is a design diagram of a fabric of Example 9 of the present invention. FIGS. 22A and 22B include cross-sectional views taken along the lines 22A-22A and 22B-22B of warps 1 and 2 of FIG. 21 respectively. Wefts 1, 3, 5 and 7 and auxiliary wefts 2', 4', 6' and 8' are arranged at a ratio of 1:1. The upper side surface is made of four knuckles, that is, a first knuckle successively passing over one weft and one auxiliary weft which are adjacent to each other, a second knuckle successively passing over one auxiliary weft and one weft which are adjacent to each another, a fifth knuckle successively passing over one auxiliary weft and one weft which are adjacent to one another, and sixth knuckle passing over one weft. They form convex portions different in shape. Auxiliary wefts have a design of passing over two warps and under two warps. Wefts have a plain weave design of alternately passing over one warp and under one warp similar to those described in previous Examples. Warps have a design which will be a plain weave design of alternately passing over one weft and under one weft after exclusion of auxiliary wefts.

The fabric of the present example has three warp designs. Warp 1 has a design of repeating a second knuckle, warps 2 and 4 have a design of repeating two knuckles, that is, fifth knuckle and sixth knuckle. Warp 3 has a design of repeating a first knuckle. By these designs, concave-convex portions different in shape are formed. Concave portions are different in depth and shape and in addition, they are not arranged in the same row direction. The fabric is, as a whole, equipped with convex and concave portions, which are different in shape and depth, disposed at random.

Example 10

Figure 23:
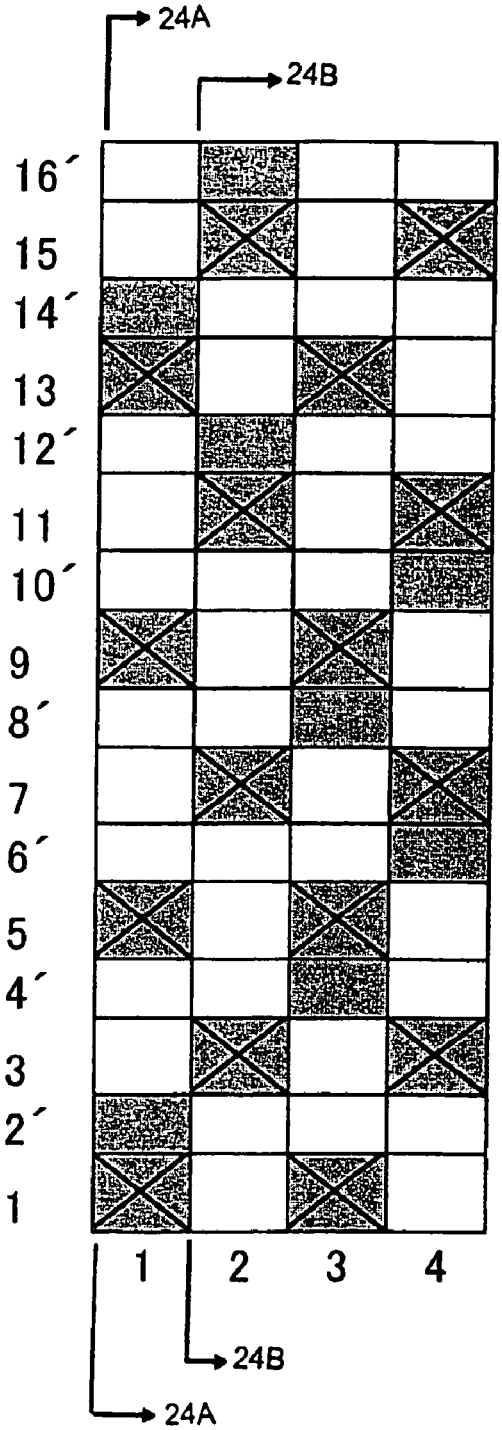
FIG. 23 is a design diagram showing a repeating unit of a fabric of Example 10 according to the present invention.
Figures 24A, 24B:
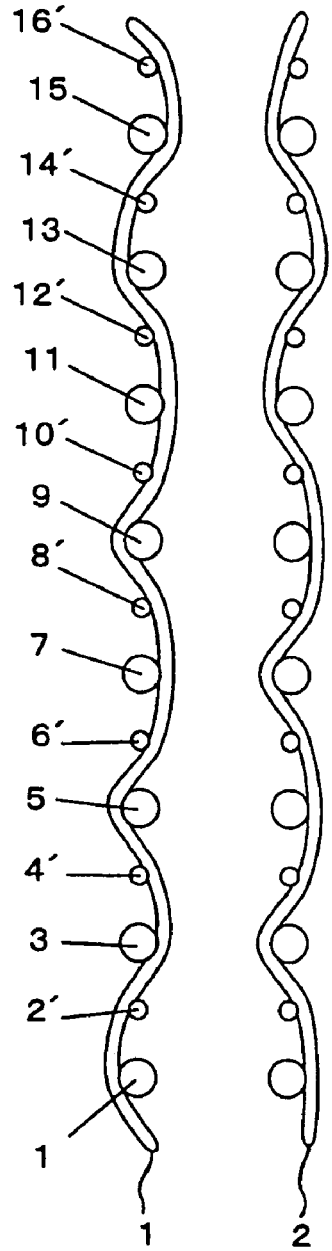
FIGS. 24A and 24B include cross-sectional views taken along the lines 24A-24A and 24B-24B of warps 1 and 2 of FIG. 23 respectively.

FIG. 23 is a design diagram of a fabric of Example 10 of the present invention. FIGS. 24A and 24B include cross-sectional views taken along the lines 24A-24A and 24B-24B of warps 1 and 2 of FIG. 23 respectively Wefts 1, 3, 5, 7, 9, 11, 13 and 15 and auxiliary wefts 2', 4', 6', 8', 10', 12', 14' and 16' are arranged at a ratio of 1:1. The upper side surface is made of three knuckles, that is, a first knuckle successively passing over one weft and one auxiliary weft which are adjacent to each other, a second knuckle successively passing over one auxiliary weft and one weft which are adjacent to each other and a sixth knuckle passing over one weft. These knuckles correspond to convex portions different in shape. Auxiliary wefts have a design of passing over one warp and under three warps. Wefts have a plain weave design of alternately passing over one warp and under one warp, and warps have a design which will be a plain weave design of alternately passing over one weft and under one weft after exclusion of auxiliary wefts.

The fabric of this Example has two warp designs. Warps 1 and 2 have a design of repeating two first knuckles and two sixth knuckles, while warps 3 and 4 have a design of repeating two second knuckles and two sixth knuckles. By these designs, concave-convex portions different in shape are formed. Concave portions are different in depth and shape and in addition, they are not arranged in the same row direction. The fabric is, as a whole, equipped with convex and concave portions, which are different in shape and depth, disposed at random.

Example 11

Figure 25:
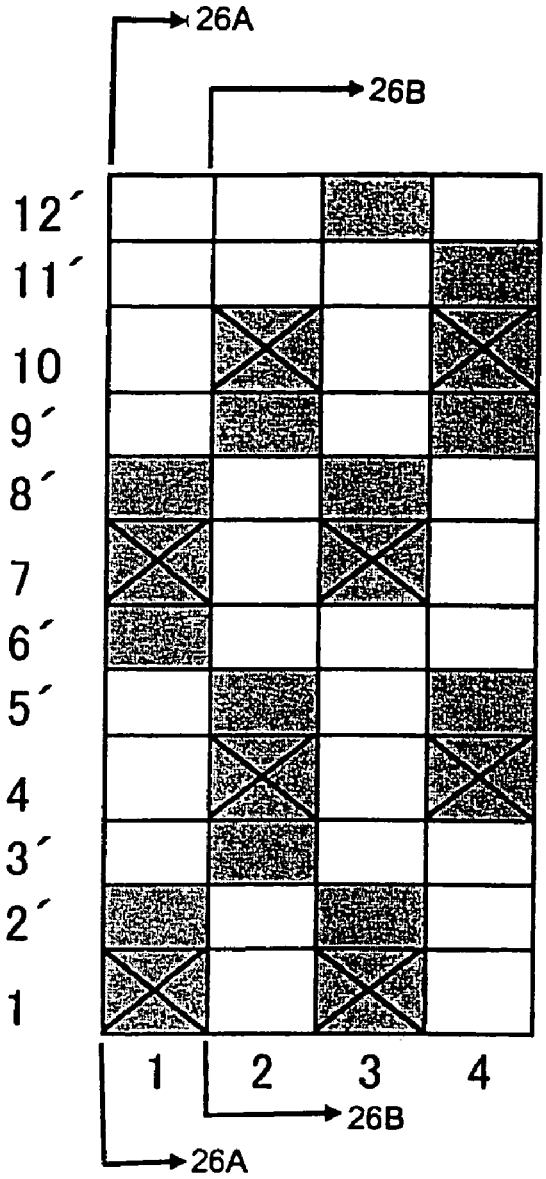
FIG. 25 is a design diagram showing a repeating unit of a fabric of Example 11 according to the present invention.
Figure 26A:
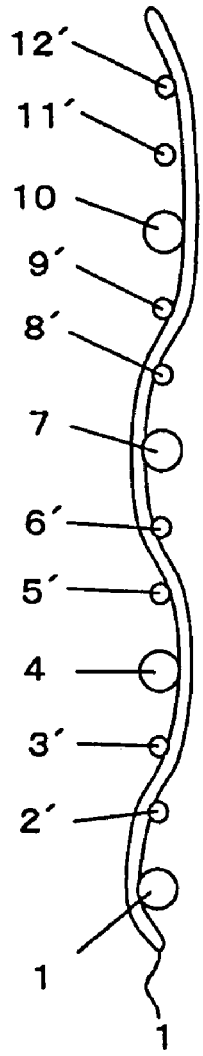
FIGS. 26A and 26B include cross-sectional views taken along the lines 26A-26A and 26B-26B of warps 1 and 2 of FIG. 25 respectively.
Figure 26B:
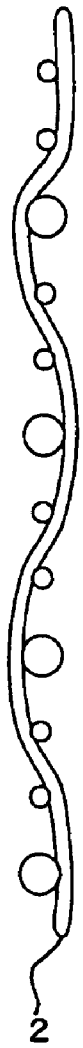

FIG. 25 is a design diagram of a fabric of Example 11 of the present invention. FIGS. 26A and 26B include cross-sectional views taken along the lines 26A-26A and 26B-26B of warps 1 and 2 of FIG. 25 respectively. Wefts 1, 4, 7 and 10 and auxiliary wefts 2', 3', 5', 6', 8', 9', 11' and 12' are arranged at a ratio of 1:2. Auxiliary wefts have two designs, that is, a design of passing over one warp and under three warps and another design of passing over one warp and under one warp. Wefts have a plain weave design of alternately passing over one warp and under one warp, and warps have a design which will be a plain weave design of alternately passing over one weft and under one weft after exclusion of auxiliary wefts. The upper side surface is made of three knuckles, that is, a first knuckle successively passing over one weft and one auxiliary weft which are adjacent to each other, a second knuckle successively passing over one auxiliary weft and one weft which are adjacent to each other, and a fifth knuckle successively passing over one auxiliary weft, one weft and one auxiliary weft which are adjacent to one another. These knuckles correspond to convex portions different in shape.

The fabric of this Example has two warp designs. Warps 1, 3 and 4 have a design of repeating a first knuckle and a fifth knuckle, and warps 2 has a design of repeating a second knuckle and sixth knuckle. By these designs, concave-convex portions different in shape are formed. Concave portions are different in depth and shape and in addition, they are not arranged in the same row direction. As a result, the fabric is, as a whole, equipped with convex and concave portions, which are different in shape and depth, disposed at random.

Example 12

Figure 27:
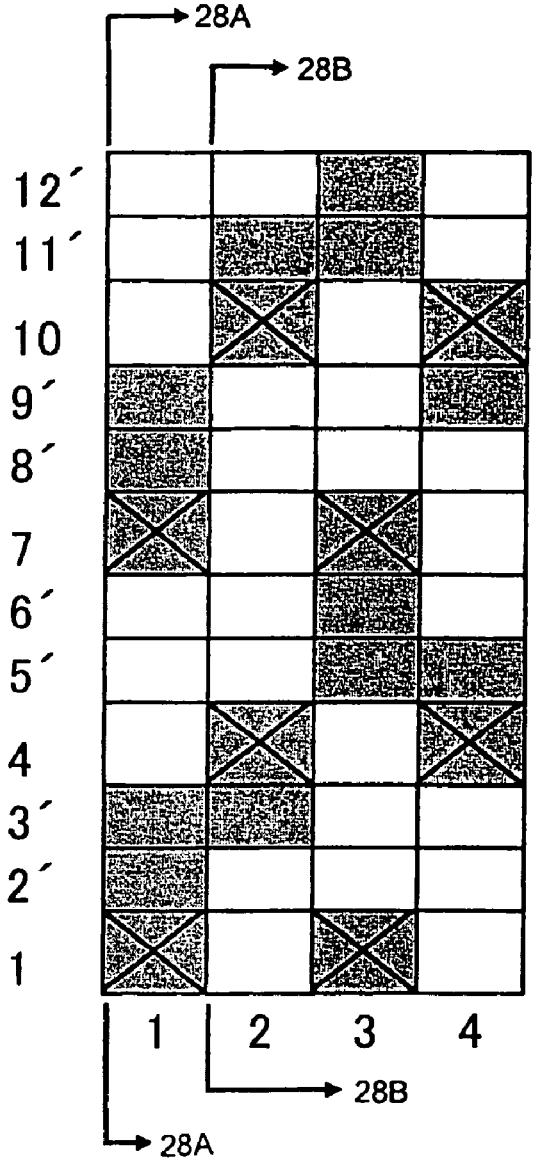
FIG. 27 is a design diagram showing a repeating unit of a fabric of Example 12 according to the present invention.
Figure 28A:
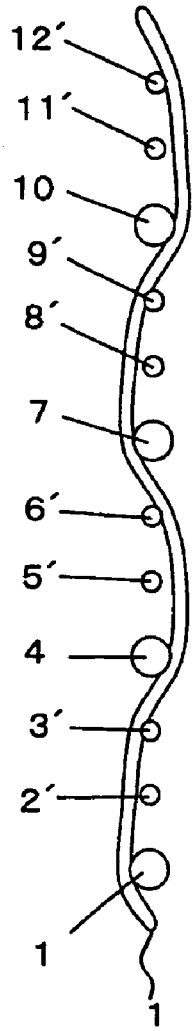
FIGS. 28A and 28B include cross-sectional views taken along the lines 28A-28A and 28B-28B of warps 1 and 2 of FIG. 27 respectively.
Figure 28B:
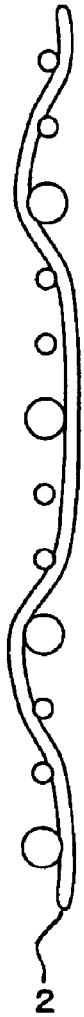

FIG. 27 is a design diagram of a fabric of Example 12 of the present invention. FIGS. 28A and 28B include cross-sectional views taken along the lines 28A-28A and 28B-28B of warps 1 and 2 of FIG. 27 respectively. Wefts 1, 4, 7 and 10 and auxiliary wefts 2', 3', 5', 6', 8', 9', 11' and 12' are arranged at a ratio of 1:2. Auxiliary wefts have two designs, that is, a design of passing over one warp and under three warps and a design of passing over two warps and under two warps. Wefts have a plain weave design of alternately passing over one warp and under one warp, and warps have a design which will be a plain weave design of alternately passing over one weft and under one weft after exclusion of auxiliary wefts. The upper side surface is made of four knuckles, that is, a first knuckle successively passing over one weft and one auxiliary weft adjacent to each other, a second knuckle successively passing over one auxiliary weft and one weft adjacent to each other, a third knuckle successively passing over one weft and two auxiliary wefts adjacent to one another, and a fourth knuckle successively passing over two auxiliary wefts and one weft adjacent to one another. These knuckles correspond to convex portions different in shape.

This fabric has three warp designs. Warp 1 has a design of repeating a third knuckle, warps 2 and 4 have a design of repeating a first knuckle and a second knuckle, and warp 3 has a design of repeating a fourth knuckle. By these designs, concave-convex portions different in shape are formed. Concave portions are different in depth and shape and in addition, they are not arranged in the same row direction. As a result, the fabric is, as a whole, equipped with convex and concave portions, which are different in shape and depth, disposed at random.

Example 13

Figure 29:
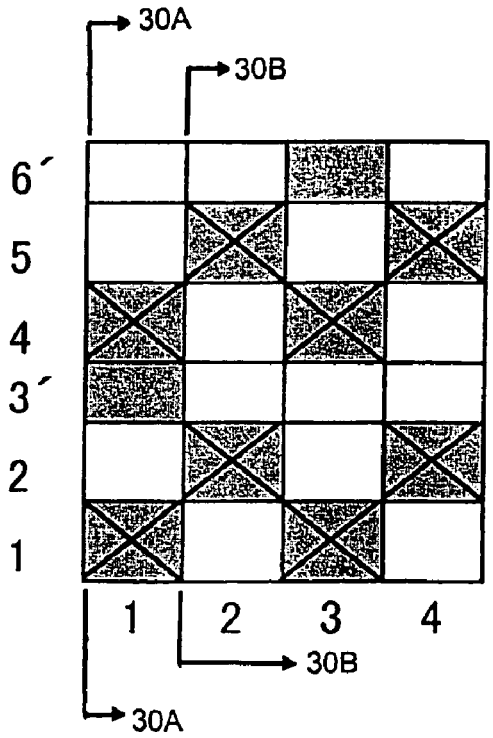
FIG. 29 is a design diagram showing a repeating unit of a fabric of Example 13 according to the present invention.
Figure 30A:
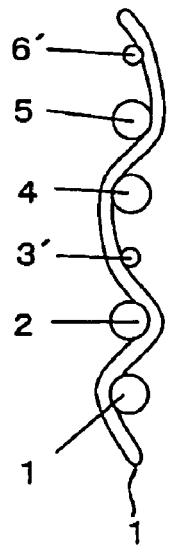
FIGS. 30A and 30B include cross-sectional views taken along the lines 30A-30A and 30B-30B of warps 1 and 2 of FIG. 29 respectively.
Figure 30B:
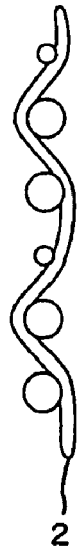

FIG. 29 is a design diagram of a fabric of Example 13 of the present invention. FIGS. 30A and 30B include cross-sectional views taken along the lines 30A-30A and 30B-30B of warps 1 and 2 of FIG. 29 respectively. Wefts 1, 2, 4 and 5 and auxiliary wefts 3' and 6' are arranged at a ratio of 2:1, meaning that two wefts are followed by one auxiliary weft. Auxiliary wefts have a design of passing over one warp and then passing under three warps. Wefts have a plain weave design of alternately passing over one warp and under one warp, and warps have a design which will be a plain weave design of alternately passing over one weft and under one weft after exclusion of auxiliary wefts. As in this Example, the number of wefts may be greater than that of auxiliary wefts. The upper side surface is made of two knuckles, that is, a second knuckle of successively passing over one auxiliary weft and one weft which are adjacent to each other, and a sixth knuckle of passing over one weft. These knuckles correspond to convex portions different in shape.

The fabric of this Example has two warp designs. Warps 1 and 3 have a design of repeating a second knuckle and a sixth knuckle, and warps 2 and 4 have a design of repeating a sixth knuckle. By these designs, concave-convex portions different in shape are formed. Concave portions are different in depth and shape and in addition, they are not arranged in the same row direction. As a result, the fabric is, as a whole, equipped with convex and concave portions, which are different in shape and depth, disposed at random.

Example 14

Figure 32B:
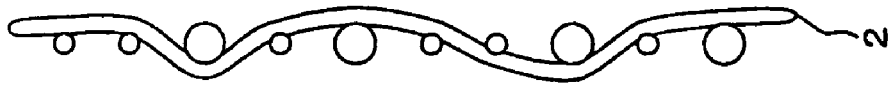
FIGS. 32A and 32B includes cross-sectional views taken along the lines 32A-32A and 32B-32B of warps 1 and 2 of FIG. 31 respectively.
Figure 32A:
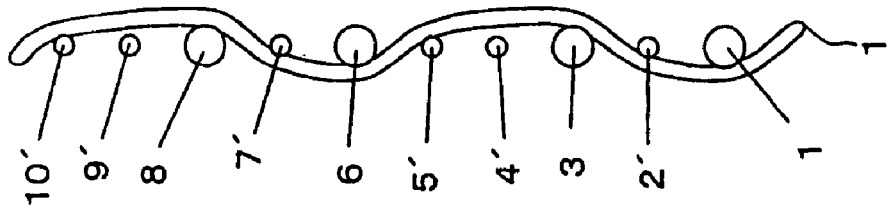
Figure 31:
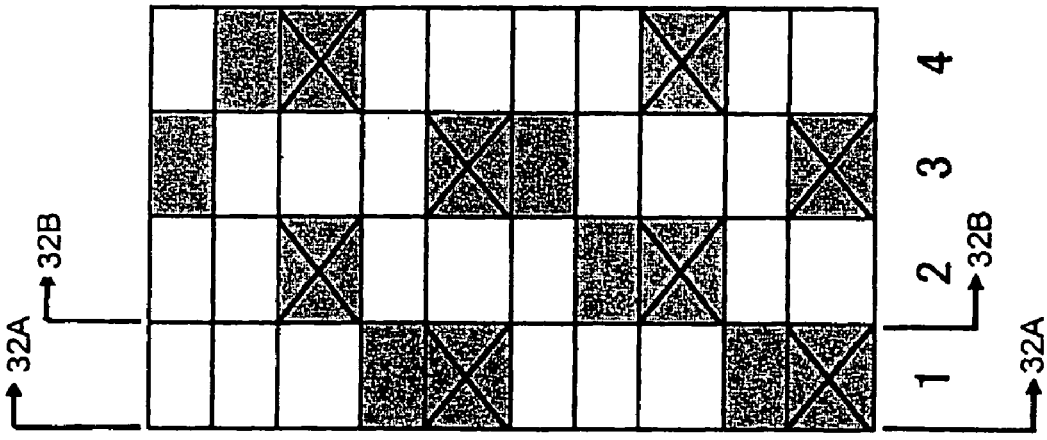
FIG. 31 is a design diagram showing a repeating unit of a fabric of Example 14 according to the present invention.

FIG. 31 is a design diagram of a fabric of Example 14 of the present invention. FIGS. 32A and 32B includes cross-sectional views taken along the lines 32A-32A and 32B-32B of warps 1 and 2 of FIG. 31 respectively. Wefts 1, 3, 6 and 8 and auxiliary wefts 2' 4' 5' 7' 9' and 10' are arranged at a ratio of 2:3, more specifically, one weft, one auxiliary weft, one weft and two auxiliary wefts are arranged in the order of mention. They can be arranged in such an irregular manner. Such an irregular arrangement can also be employed. Auxiliary wefts have a design of passing over one warp and then passing under three warps. Wefts have a plain weave design of alternately passing over one warp and under one warp, and warps have a design which will be a plain weave design of alternately passing over one weft and under one weft after exclusion of auxiliary wefts. The upper side surface is made of three knuckles, that is, a first knuckle successively passing over one weft and one auxiliary weft which are adjacent to each other, a second knuckle successively passing over one auxiliary weft and one weft which are adjacent to each other, and a sixth knuckle passing over one weft. These knuckles correspond to convex portions different in shape.

This fabric of this Example has three warp designs. Warp 1 has a design of repeating a first knuckle, warps 2 and 4 have a design of repeating a first knuckle and a sixth knuckle, and warp 3 has a design of repeating a second knuckle. By these designs, concave-convex portions different in shape are formed. Concave portions are different in depth and shape and in addition, they are not arranged in the same row direction. As a result, the fabric is, as a whole, equipped with convex and concave portions, which are different in shape and depth, disposed at random.

Example 15

Figure 33:
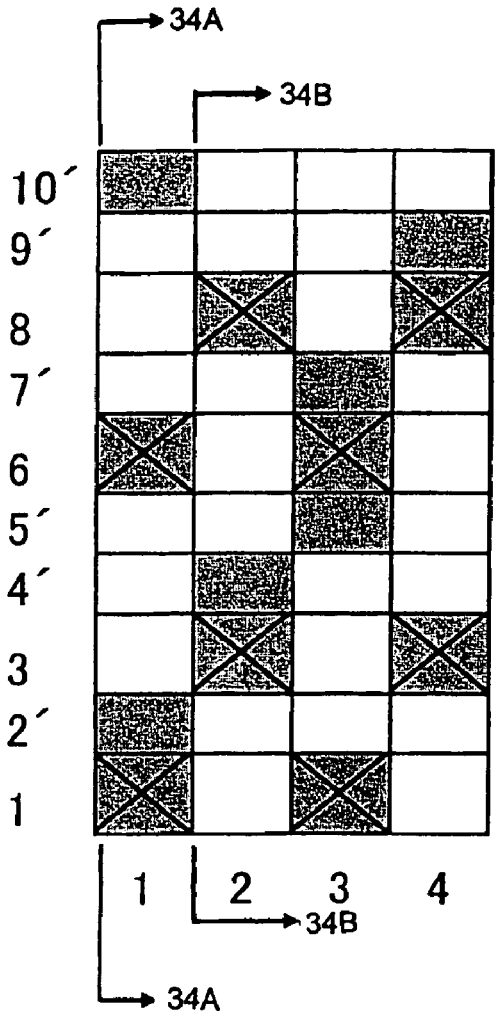
FIG. 33 is a design diagram showing a repeating unit of a fabric of Example 15 according to the present invention.
Figures 34A, 34B:
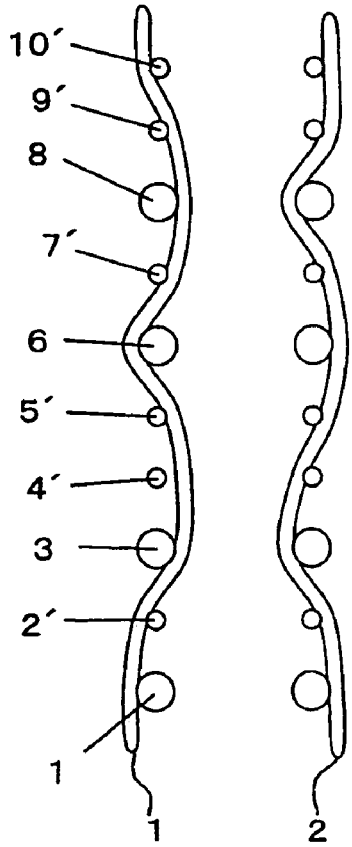
FIGS. 34A and 34B include cross-sectional views taken along the lines 34A-34A and 34B-34B of warps 1 and 2 of FIG. 33 respectively.

FIG. 33 is a design diagram of a fabric of Example 15 of the present invention. FIGS. 34A and 34B include cross-sectional views taken along the lines 34A-34A and 34B-34B of warps 1 and 2 of FIG. 33 respectively. Wefts 1, 3, 6 and 8 and auxiliary wefts 2' 4' 5' 7' 9' and 10' are arranged at a ratio of 2:3, more specifically, one weft, one auxiliary weft, one weft and two auxiliary wefts are arranged in the order of mention. Auxiliary wefts have a design of passing over one warp and then passing under three warps. Wefts have a plain weave design of alternately passing over one warp and under one warp, and warps have a design which will be a plain weave design of alternately passing over one weft and under one weft after exclusion of auxiliary wefts. The upper side surface is made of three knuckles, that is, a first knuckle successively passing over one weft and one auxiliary weft which are adjacent to each other, a fifth knuckle successively passing over one auxiliary weft, one weft and one auxiliary weft which are adjacent to one another, and a sixth knuckle passing over one weft. These knuckles correspond to convex portions different in shape. The fabric of this Example has two warp designs. Warps 1 and 3 have a design of repeating a fifth knuckle and a sixth knuckle, while warps 2 and 4 have a design of repeating a first knuckle and a sixth knuckle. By these designs, concave-convex portions different in shape are formed. Concave portions are different in depth and shape and in addition, they are not arranged in the same row direction. As a result, the fabric is, as a whole, equipped with convex and concave portions, which are different in shape and depth, disposed at random.

The fabrics of the present invention have, on the surface thereof, concave and convex portions which are different in shape so that they are suited for use as a fabric for manufacturing non-woven fabric or paper which is bulky and has a concave-convex mark and in addition, have excellent fiber supporting property, sheet release property and adaptability to high-speed machine.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

What is claimed is:

1. An industrial single-layer fabric having a concave-convex upper side surface and a lower side surface, which comprises warps, wefts and auxiliary wefts having a smaller diameter than the wefts:

wherein, on the upper side surface in a repeating unit, at least two different upper side knuckles selected from first through sixth knuckles formed by the warps, each of the warps passes over one weft and zero to two auxiliary wefts;

wherein, on the lower side surface in the repeating unit, at least two kinds of lower side knuckles are formed by the warps, each of the warps passes under one weft and zero to four auxiliary wefts;

wherein, the wefts form a plain weave design by alternatively passing over one warp and passing under one warp; and wherein, the first knuckle is formed by one of the warps that successively passes over one weft and then one auxiliary weft which are adjacent to each other;

the second knuckle is formed by one of the warps that successively passes over one auxiliary weft and then one weft which are adjacent to each other;

the third knuckle is formed by one of the warps that successively passes over one weft and then two auxiliary wefts which are adjacent to one another;

the fourth knuckle is formed by one of the warps that successively passes over two auxiliary wefts and then one weft which are adjacent to one another;

the fifth knuckle is formed by one of the warps that successively passes over one auxiliary weft, then one weft and then one auxiliary weft which are adjacent to one another; and the sixth knuckle is formed by one of the warps that passes over one weft only.

2. The industrial single-layer fabric according to claim 1, wherein each one of the warps forms only one of the first through sixth knuckles.

3. The industrial single-layer fabric according to claim 1, wherein each one of warps forms any two of the first through sixth knuckles.

4. The industrial single-layer fabric according to claim 1, wherein one of the warps forms only one of the first through sixth knuckles and another one of the warps forms any two of the first through sixth knuckles.

5. The industrial single-layer fabric according to claim 1, wherein the wefts and the auxiliary wefts are arranged at a ratio of from 2:1 to 1:2.

6. The industrial single-layer fabric according to claim 1, wherein the wefts and the auxiliary wefts are arranged at a ratio of from 2:1 to 2:3.

7. The industrial single-layer fabric according to claim 1, wherein the auxiliary wefts have one or two designs.

8. The industrial single-layer fabric according to claim 1, wherein the warps and the wefts are each any one of monofilaments, bundled monofilaments or twisted yarns, while the auxiliary wefts are each any one of monofilaments, multifilaments, twisted yarns, fancy yarns, and hollow yarns.

9. The industrial single-layer fabric according to claim 1, wherein at least a portion of the warps and/or the wefts is a flat yarn.

10. The industrial single-layer fabric according to claim 1, wherein the warps are more protruded from the upper side or the lower side surface than the wefts.

* * * * *